US008595019B2

(12) United States Patent
Geiger et al.

(10) Patent No.: US 8,595,019 B2
(45) Date of Patent: Nov. 26, 2013

(54) AUDIO CODER/DECODER WITH PREDICTIVE CODING OF SYNTHESIS FILTER AND CRITICALLY-SAMPLED TIME ALIASING OF PREDICTION DOMAIN FRAMES

(75) Inventors: Ralf Geiger, Nuremberg (DE); Bernhard Grill, Lauf (DE); Bruno Bessette, Sherbrooke (CA); Philippe Gournay, Sherbrooke (CA); Guillaume Fuchs, Erlangen (DE); Markus Multrus, Nuremberg (DE); Max Neuendorf, Nuremberg (DE); Gerald Schuller, Erfurt (DE)

(73) Assignees: Fraunhofer-Gesellschaft zur Foerderung der angewandten Forschung e.V., Munich (DE); Voiceage Corporation, Montreal, Quebec (CA)

( * ) Notice: Subject to any disclaimer, the term of this patent is extended or adjusted under 35 U.S.C. 154(b) by 282 days.

(21) Appl. No.: 13/004,475

(22) Filed: Jan. 11, 2011

(65) Prior Publication Data

US 2011/0173011 A1 Jul. 14, 2011

Related U.S. Application Data

(63) Continuation of application No. PCT/EP2009/004015, filed on Jun. 4, 2009.

(60) Provisional application No. 61/079,862, filed on Jul. 11, 2008, provisional application No. 61/103,825, filed on Oct. 8, 2008.

(30) Foreign Application Priority Data

Oct. 8, 2008 (EP) ..... 08017661

(51) Int. Cl.
*G10L 19/00* (2013.01)
*G10L 19/02* (2013.01)
*G10L 19/04* (2013.01)

(52) U.S. Cl.
USPC ..... 704/501; 704/219; 704/221

(58) Field of Classification Search
USPC ..... 704/201, 205, 206, 219, 220, 221, 223, 704/500, 501
See application file for complete search history.

(56) References Cited

U.S. PATENT DOCUMENTS 5,781,888 A * 7/1998 Herre ..... 704/200.1
5,812,971 A * 9/1998 Herre ..... 704/230

(Continued)

FOREIGN PATENT DOCUMENTS

CN 1055830 10/1991
WO WO 91/16769 A1 10/1991

(Continued)

OTHER PUBLICATIONS

Princen and Bradley, "Analysis/Synthesis Filter Bank Design Based on Time Domain Aliasing Cancellation", IEEE Transactions on Acoustics, Speech, and Signal Processing, vol. ASSP-34, No. 5, Oct. 1986, pp. 1153 to 1161.*

(Continued)

*Primary Examiner* — Martin Lerner
(74) *Attorney, Agent, or Firm* — Michael A. Glenn; Perkins Coie LLP

(57) ABSTRACT

An audio encoder adapted for encoding frames of a sampled audio signal to obtain encoded frames, wherein a frame includes a number of time domain audio samples. The audio encoder includes a predictive coding analysis stage for determining information on coefficients of a synthesis filter and a prediction domain frame based on a frame of audio samples. The audio encoder further includes a time-aliasing introducing transformer for transforming overlapping prediction domain frames to the frequency domain to obtain prediction domain frame spectra, wherein the time-aliasing introducing transformer is adapted for transforming the overlapping prediction domain frames in a critically-sampled way. Moreover, the audio encoder includes a redundancy reducing encoder for encoding the prediction domain frame spectra to obtain the encoded frames based on the coefficients and the encoded prediction domain frame spectra.

21 Claims, 31 Drawing Sheets

(56) References Cited

U.S. PATENT DOCUMENTS

| | | | | |
|---|---|---|---|---|
| 7,596,489 | B2 * | 9/2009 | Kovesi et al. | 704/219 |
| 7,599,833 | B2 * | 10/2009 | Sung et al. | 704/219 |
| 8,032,359 | B2 * | 10/2011 | Shlomot et al. | 704/201 |
| 8,321,210 | B2 * | 11/2012 | Grill et al. | 704/205 |
| 8,447,620 | B2 * | 5/2013 | Neuendorf et al. | 704/500 |
| 8,457,975 | B2 * | 6/2013 | Neuendorf et al. | 704/500 |
| 8,484,038 | B2 * | 7/2013 | Bessette et al. | 704/500 |
| 2002/0040299 | A1 | 4/2002 | Makino et al. | |
| 2004/0044534 | A1 * | 3/2004 | Chen et al. | 704/501 |
| 2005/0185850 | A1 | 8/2005 | Vinton et al. | |
| 2007/0106502 | A1 * | 5/2007 | Kim et al. | 704/207 |
| 2007/0147518 | A1 * | 6/2007 | Bessette | 375/243 |
| 2008/0027719 | A1 * | 1/2008 | Kirshnan et al. | 704/214 |
| 2010/0138218 | A1 * | 6/2010 | Geiger | 704/205 |
| 2010/0217607 | A1 * | 8/2010 | Neuendorf et al. | 704/500 |
| 2010/0268542 | A1 * | 10/2010 | Kim et al. | 704/501 |
| 2011/0173008 | A1 * | 7/2011 | Lecomte et al. | 704/500 |
| 2011/0173009 | A1 * | 7/2011 | Fuchs et al. | 704/500 |
| 2011/0173010 | A1 * | 7/2011 | Lecomte et al. | 704/500 |
| 2011/0200125 | A1 * | 8/2011 | Multrus et al. | 375/259 |
| 2011/0202354 | A1 * | 8/2011 | Grill et al. | 704/500 |
| 2011/0238425 | A1 * | 9/2011 | Neuendorf et al. | 704/500 |
| 2012/0022881 | A1 * | 1/2012 | Geiger et al. | 704/504 |
| 2012/0209600 | A1 * | 8/2012 | Kim et al. | 704/219 |
| 2012/0239408 | A1 * | 9/2012 | Oh et al. | 704/500 |
| 2012/0245947 | A1 * | 9/2012 | Neuendorf et al. | 704/500 |
| 2012/0253797 | A1 * | 10/2012 | Geiger et al. | 704/219 |
| 2012/0265541 | A1 * | 10/2012 | Geiger et al. | 704/500 |
| 2012/0271644 | A1 * | 10/2012 | Bessette et al. | 704/500 |
| 2013/0066640 | A1 * | 3/2013 | Grill et al. | 704/500 |
| 2013/0096930 | A1 * | 4/2013 | Neuendorf et al. | 704/500 |

FOREIGN PATENT DOCUMENTS

| | | | |
|---|---|---|---|
| WO | WO 2004/082288 | A1 | 9/2004 |
| WO | WO 2008/071353 | A | 6/2008 |

OTHER PUBLICATIONS

Bessette B et al: "Universal Speech/Audio Coding Using Hybrid ACELP/TCS Techniques"; Acoustics, Speech, and Signal Processing, 2005. Proceedings. (ICASSP ' 05). IEEE International Conference on Philadelphia, Pennsylvania, USA Mar. 18-23, 2005, Piscataway, NY, USA, IEEE, vol. 3, Mar. 18, 2005, pp. 301-304, XP010792234, ISBN: 978-0-7803-8874-1; p. 301, left-hand column, line 1—line 9; p. 301, right-hand column, line 9—line 35; p. 301, left-hand column, line 46—line 48; p. 302, left-hand column, line 1—line 51; p. 302, right-hand column, line 9—p. 303, left-hand column, line 24;.

Juin-Hwey Chen: "A candidate coder for the ITU-T' s new wideband speech coding standard", Acoustics, Speech, and Signal Processing, 1997. ICASSP-97., 1997 IEEE International Conference on Munich, Germany Apr. 21-24, 1997, Los Alamitos, CA, USA, IEEE Comput. Soc., US, vol. 2, Apr. 21, 1997, pp. 1359-1362, XP010226055, Munich, Germany; ISBN: 978-0-8186-7919-3; p. 1359, left-hand column, line 20—line 32, p. 1359, right-hand column, line 9—line 36, p. 1360, left-hand column, line 52—right-hand column, line 28, p. 1360, right-hand column, line 50—p. 1361, left-hand column, line 7.

Ramprashad S A: "A Multimode Transform Predictive Coder (MTPC) for Speech and Audio", IEEE Workshop on Speech Coding Proceedings. Model, Coders Anderror Criteria, XX, XX, Jan. 1, 1999, pp. 10-12, XP001010827; p. 10, left-hand column, line 27—right-hand column, line 18, p. 10, right-hand column, line 29—line 38, p. 11, left-hand column, line 8—line 50.

Schnitzler J et al: "Trends and perspectives in wideband speech coding" Signal Processing, Elsevier, Science Publishers B.V. Amsterdam, NL, vol. 80, No. 11, Nov. 1, 2000, pp. 2267-2281, XP004218323, ISSN: 0165-1684, p. 2273, right-hand column, line 19—p. 2274, right-hand column, line 17.

PCT/EP2009/004015 International Search Report and Written Opinion; 18 pages; mailed date May 8, 2009.

* cited by examiner a) $$X_k=\sum_{n=0}^{2N-1} x_n \cos\left[\frac{\pi}{N}\left(n+\frac{1}{2}+\frac{N}{2}\right)\left(k+\frac{1}{2}\right)\right]$$

b) $$y_n=\frac{1}{N}\sum_{k=0}^{N-1} X_k \cos\left[\frac{\pi}{N}\left(n+\frac{1}{2}+\frac{N}{2}\right)\left(k+\frac{1}{2}\right)\right]$$

c) $$w_n^2 + w_{n+N}^2=1$$

d) $$w_n = \sin\left[\frac{\pi}{2N}\left(n+\frac{1}{2}\right)\right]$$

e) $$w_n = \sin\left(\frac{\pi}{2}\sin^2\left[\frac{\pi}{2N}\left(n+\frac{1}{2}\right)\right]\right)$$

f) $$\cos\left[\frac{\pi}{N}\left(-n-1+\frac{1}{2}\right)\left(k+\frac{1}{2}\right)\right]=\cos\left[\frac{\pi}{N}\left(n+\frac{1}{2}\right)\left(k+\frac{1}{2}\right)\right] \text{ and}$$
$$\cos\left[\frac{\pi}{N}\left(2N-n-1+\frac{1}{2}\right)\left(k+\frac{1}{2}\right)\right]=-\cos\left[\frac{\pi}{N}\left(n+\frac{1}{2}\right)\left(k+\frac{1}{2}\right)\right]$$

g) $$\mathrm{IMDCT}(\mathrm{MDCT}(a, b, c, d)) = (a-b_R,\ b-a_R,\ c+d_R,\ c_R+d)/2$$

h) $$(z_R,\ w_R)\cdot(z_R c+w d_R, z c_R+w_R d)=(z_R^2 c+w z_R d_R, w_R z c_R+w_R^2 d)$$

i) $$(w,\ z)\cdot(wc-z_R d_R,\ zd-w_R c_R)=(w^2 c+w z_R d_R,\ z^2 d-w_R z c_R)$$

j) $$(z_R^2 c+w z_R d_R,\ w_R z c_R+w_R^2 d)+(w^2 c-w z_R d_R,\ z^2 d-w_R z c_R)$$
$$=([z_R^2+w^2]c+[w z_R-w z_R]d_R, [w_R^2+z^2]d+[w_R z-w_R z]c_R)=(c,d)$$

FIG 2 analysis-by-synthesis CELP $A_L(z)$: long-term prediction
≙ pitch (fine) structure A(z): short-term prediction
≙ formant structure/spectral envelope

| transition to → / from ↓ | TCX80 | TCX40 | TCX20 |
|---|---|---|---|
| ACELP | L=128, M=1024, R=128, PR=1024, T=1152 | L=0, M=512, R=128, PR=512, T=576 | L=0, M=256, R=128, PR=256, T=320 |
| TCX20 | L=128, M=896, R=128, PR=1024, T=1024 | L=128, M=384, R=128, PR=512, T=512 | L=128, M=128, R=128, PR=256, T=256 |
| TCX40 | L=128, M=896, R=128, PR=1024, T=1024 | L=128, M=384, R=128, PR=512, T=512 | L=128, M=128, R=128, PR=256, T=256 |
| TCX80 | L=128, M=896, R=128, PR=1024, T=1024 | L=128, M=384, R=128, PR=512, T=512 | L=128, M=128, R=128, PR=256, T=256 |

window parameters for AMR-WB+

| transition to→ ↓ from | TCX80 | TCX40 | TCX20 |
|---|---|---|---|
| ACELP | L=0, M=1024, R=128, PR=1024,T=1152 | L=0, M=512, R=64, PR=512,T=576 | L=0, M=256, R=32, PR=256,T=288 |
| TCX20 | L=32, M=992, R=128, PR=1024,T=1152 | L=32, M=480, R=64, PR=512,T=576 | L=32, M=224, R=32, PR=256,T=288 |
| TCX40 | L=64, M=960, R=128, PR=1024,T=1152 | L=64, M=448, R=64, PR=512,T=576 | L=64, M=192, R=32, PR=256,T=288 |
| TCX80 | L=128, M=896, R=128, PR=1024,T=1152 | L=128, M=384, R=64, PR=512,T=576 | L=128, M=128, R=32, PR=256,T=288 |

AUDIO CODER/DECODER WITH PREDICTIVE CODING OF SYNTHESIS FILTER AND CRITICALLY-SAMPLED TIME ALIASING OF PREDICTION DOMAIN FRAMES

CROSS-REFERENCE TO RELATED APPLICATIONS

This application is a continuation of copending International Application No. PCT/EP2009/004015, filed Jun. 4, 2009, which is incorporated herein by reference in its entirety, and claims priority to U.S. Patent Application No. 61/079,862 filed Jul. 11, 2008 and U.S. Patent Application No. 61/103,825 filed Oct. 8, 2008, and additionally claims priority from European Application No. 08017661.3, filed Oct. 8, 2008, which are all incorporated herein by reference in their entirety.

BACKGROUND OF THE INVENTION

The present invention relates to source coding and particularly to audio source coding, in which an audio signal is processed by two different audio coders having different coding algorithms.

In the context of low bitrate audio and speech coding technology, several different coding techniques have traditionally been employed in order to achieve low bitrate coding of such signals with best possible subjective quality at a given bitrate. Coders for general music/sound signals aim at optimizing the subjective quality by shaping a spectral (and temporal) shape of the quantization error according to a masking threshold curve which is estimated from the input signal by means of a perceptual model ("perceptual audio coding"). On the other hand, coding of speech at very low bitrates has been shown to work very efficiently when it is based on a production model of human speech, i.e. employing Linear Predictive Coding (LPC) to model the resonant effects of the human vocal tract together with an efficient coding of the residual excitation signal.

As a consequence of these two different approaches, general audio coders, like MPEG-1 Layer 3 (MPEG=Moving Pictures Expert Group), or MPEG-2/4 Advanced Audio Coding (AAC) usually do not perform as well for speech signals at very low data rates as dedicated LPC-based speech coders due to the lack of exploitation of a speech source model. Conversely, LPC-based speech coders usually do not achieve convincing results when applied to general music signals because of their inability to flexibly shape the spectral envelope of the coding distortion according to a masking threshold curve. In the following, concepts are described which combine the advantages of both LPC-based coding and perceptual audio coding into a single framework and thus describe unified audio coding that is efficient for both general audio and speech signals.

Traditionally, perceptual audio coders use a filterbank-based approach to efficiently code audio signals and shape the quantization distortion according to an estimate of the masking curve.

FIG. 16*b* shows the basic block diagram of a monophonic perceptual coding system. An analysis filterbank 1600 is used to map the time domain samples into subsampled spectral components. Dependent on the number of spectral components, the system is also referred to as a subband coder (small number of subbands, e.g. 32) or a transform coder (large number of frequency lines, e.g. 512). A perceptual ("psychoacoustic") model 1602 is used to estimate the actual time dependent masking threshold. The spectral ("subband" or "frequency domain") components are quantized and coded 1604 in such a way that the quantiza-tion noise is hidden under the actual transmitted signal, and is not perceptible after decoding. This is achieved by varying the granularity of quantization of the spectral values over time and frequency.

The quantized and entropy-encoded spectral coefficients or subband values are, in addition with side information, input into a bitstream formatter 1606, which provides an encoded audio signal which is suitable for being transmitted or stored. The output bitstream of block 1606 can be transmitted via the Internet or can be stored on any machine readable data carrier.

On the decoder-side, a decoder input interface 1610 receives the encoded bitstream. Block 1610 separates entropy-encoded and quantized spectral/subband values from side information. The encoded spectral values are input into an entropy-decoder such as a Huffman decoder, which is positioned between 1610 and 1620. The outputs of this entropy decoder are quantized spectral values. These quantized spectral values are input into a requantizer, which performs an "inverse" quantization as indicated at 1620 in FIG. 16. The output of block 1620 is input into a synthesis filterbank 1622, which performs a synthesis filtering including a frequency/time transform and, typically, a time domain aliasing cancellation operation such as overlap and add and/or a synthesis-side windowing operation to finally obtain the output audio signal.

Traditionally, efficient speech coding has been based on Linear Predictive Coding (LPC) to model the resonant effects of the human vocal tract together with an efficient coding of the residual excitation signal. Both LPC and excitation parameters are transmitted from the encoder to the decoder. This principle is illustrated in FIGS. 17*a* and 17*b*.

FIG. 17*a* indicates the encoder-side of an encoding/decoding system based on linear predictive coding. The speech input is input into an LPC analyzer 1701, which provides, at its output, LPC filter coefficients. Based on these LPC filter coefficients, an LPC filter 1703 is adjusted. The LPC filter outputs a spectrally whitened audio signal, which is also termed "prediction error signal". This spectrally whitened audio signal is input into a residual/excitation coder 1705, which generates excitation parameters. Thus, the speech input is encoded into excitation parameters on the one hand, and LPC coefficients on the other hand.

On the decoder-side illustrated in FIG. 17*b*, the excitation parameters are input into an excitation decoder 1707, which generates an excitation signal, which can be input into an LPC synthesis filter. The LPC synthesis filter is adjusted using the transmitted LPC filter coefficients. Thus, the LPC synthesis filter 1709 generates a reconstructed or synthesized speech output signal.

Over time, many methods have been proposed with respect to an efficient and perceptually convincing representation of the residual (excitation) signal, such as Multi-Pulse Excitation (MPE), Regular Pulse Excitation (RPE), and Code-Excited Linear Prediction (CELP).

Linear Predictive Coding attempts to produce an estimate of the current sample value of a sequence based on the observation of a certain number of past values as a linear combination of the past observations. In order to reduce redundancy in the input signal, the encoder LPC filter "whitens" the input signal in its spectral envelope, i.e. it is a model of the inverse of the signal's spectral envelope. Conversely, the decoder LPC synthesis filter is a model of the signal's spectral envelope. Specifically, the well-known auto-regressive (AR) linear predictive analysis is known to model the signal's spectral envelope by means of an all-pole approximation.

Typically, narrow band speech coders (i.e. speech coders with a sampling rate of 8 kHz) employ an LPC filter with an order between 8 and 12. Due to the nature of the LPC filter, a uniform frequency resolution is effective across the full frequency range. This does not correspond to a perceptual frequency scale.

In order to combine the strengths of traditional LPC/CELP-based coding (best quality for speech signals) and the traditional filterbank-based perceptual audio coding approach (best for music), a combined coding between these architectures has been proposed. In the AMR-WB+ (AMR-WB=Adaptive Multi-Rate WideBand) coder B. Bessette, R. Lefebvre, R. Salami, "UNIVERSAL SPEECH/AUDIO CODING USING HYBRID ACELP/TCX TECHNIQUES," Proc. IEEE ICASSP 2005, pp. 301-304, 2005 two alternate coding kernels operate on an LPC residual signal. One is based on ACELP (ACELP=Algebraic Code Excited Linear Prediction) and thus is extremely efficient for coding of speech signals. The other coding kernel is based on TCX (TCX=Transform Coded Excitation), i.e. a filterbank based coding approach resembling the traditional audio coding techniques in order to achieve good quality for music signals. Depending on the characteristics of the input signal signals, one of the two coding modes is selected for a short period of time to transmit the LPC residual signal. In this way, frames of 80 ms duration can be split into subframes of 40 ms or 20 ms in which a decision between the two coding modes is made.

The AMR-WB+ (AMR-WB+=extended Adaptive Multi-Rate WideBand codec), cf. 3GPP (3GPP=Third Generation Partnership Project) technical specification number 26.290, version 6.3.0, June 2005, can switch between the two essentially different modes ACELP and TCX. In the ACELP mode a time domain signal is coded by algebraic code excitation. In the TCX mode a fast Fourier transform (FFT=fast Fourier transform) is used and the spectral values of the LPC weighted signal (from which the excitation signal is derived at the decoder) are coded based on vector quantization.

The decision, which modes to use, can be taken by trying and decoding both options and comparing the resulting signal-to-noise ratios (SNR=Signal-to-Noise Ratio).

This case is also called the closed loop decision, as there is a closed control loop, evaluating both coding performances and/or efficiencies, respectively, and then choosing the one with the better SNR by discarding the other.

It is well-known that for audio and speech coding applications a block transform without windowing is not feasible. Therefore, for the TCX mode the signal is windowed with a low overlap window with an overlap of $1/8^{th}$. This overlapping region is necessary, in order to fade-out a prior block or frame while fading-in the next, for example to suppress artifacts due to uncorrelated quantization noise in consecutive audio frames. This way the overhead compared to non-critical sampling is kept reasonably low and the decoding necessary for the closed-loop decision reconstructs at least $7/8^{th}$ of the samples of the current frame.

The AMR-WB+ introduces $1/8^{th}$ of overhead in a TCX mode, i.e. the number of spectral values to be coded is $1/8^{th}$ higher than the number of input samples. This provides the disadvantage of an increased data overhead. Moreover, the frequency response of the corresponding band pass filters is disadvantageous, due to the steep overlap region of $1/8^{th}$ of consecutive frames.

In order to elaborate more on the code overhead and overlap of consecutive frames, FIG. 18 illustrates a definition of window parameters. The window shown in FIG. 18 has a rising edge part on the left-hand side, which is denoted with "L" and also called left overlap region, a center region which is denoted by "1", which is also called a region of 1 or bypass part, and a falling edge part, which is denoted by "R" and also called the right overlap region. Moreover, FIG. 18 shows an arrow indicating the region "PR" of perfect reconstruction within a frame. Furthermore, FIG. 18 shows an arrow indicating the length of the transform core, which is denoted by "T".

FIG. 19 shows a view graph of a sequence of AMR-WB+ windows and at the bottom a table of window parameters according to FIG. 18. The sequence of windows shown at the top of FIG. 19 is ACELP, TCX20 (for a frame of 20 ms duration), TCX20, TCX40 (for a frame of 40 ms duration), TCX80 (for a frame of 80 ms duration), TCX20, TCX20, ACELP, ACELP.

From the sequence of windows the varying overlapping regions can be seen, which overlap by exactly $1/8^{th}$ of the center part M. The table at the bottom of FIG. 19 also shows that the transform length "T" is by $1/8^{th}$ larger than the region of new perfectly reconstructed samples "PR". Moreover, it is to be noted that this is not only the case for ACELP to TCX transitions, but also for TCXx to TCXx (where "x" indicates TCX frames of arbitrary length) transitions. Thus, in each block an overhead of $1/8^{th}$ is introduced, i.e. critical sampling is never achieved.

When switching from TCX to ACELP the window samples are discarded from the FFT-TCX frame in the overlapping region, as for example indicated at the top of FIG. 19 by the region labeled with 1900. When switching from ACELP to TCX the windowed zero-input response (ZIR=zero-input response), which is also indicated by the dotted line 1910 at the top of FIG. 19, is removed at the encoder for windowing and added at the decoder for recovering. When switching from TCX to TCX frames the windowed samples are used for cross-fade. Since the TCX frames can be quantized differently quantization error or quantization noise between consecutive frames can be different and/or independent. Therewith, when switching from one frame to the next without cross-fade, noticeable artifacts may occur, and hence, cross-fade is necessary in order to achieve a certain quality.

From the table at the bottom of FIG. 19 it can be seen, that the cross-fade region grows with a growing length of the frame. FIG. 20 provides another table with illustrations of the different windows for the possible transitions in AMR-WB+. When transiting from TCX to ACELP the overlapping samples can be discarded. When transiting from ACELP to TCX, the zero-input response from the ACELP is removed at the encoder and added at the decoder for recovering.

It is a significant disadvantage of the AMR-WB+ that an overhead of $1/8^{th}$ is introduced.

SUMMARY

According to an embodiment, an audio encoder adapted for encoding frames of a sampled audio signal to obtain encoded frames, wherein a frame includes a number of time domain audio samples, may have: a predictive coding analysis stage for determining information on coefficients of a synthesis filter and a prediction domain frame based on a frame of audio samples; a time-aliasing introducing transformer for transforming overlapping prediction domain frames to the frequency domain to obtain prediction domain frame spectra, wherein the time-aliasing introducing transformer is adapted for transforming the overlapping prediction domain frames in a critically-sampled way; and a redundancy reducing encoder for encoding the prediction domain frame spectra to obtain the encoded frames based on the coefficients and the encoded prediction domain frame spectra.

According to another embodiment, a method for encoding frames of a sampled audio signal to obtain encoded frames, wherein a frame includes a number of time domain audio samples, may have the steps of: determining information on coefficients for a synthesis filter based on a frame of audio samples; determining a prediction domain frame based on the frame of audio samples; transforming overlapping prediction domain frames to the frequency domain to obtain prediction domain frame spectra in a critically-sampled way introducing time aliasing; and encoding the prediction domain frame spectra to obtain the encoded frames based on the coefficients and the encoded prediction domain frame spectra.

Another embodiment may have a computer program having a program code for performing the above method, when the program code runs on a computer or processor.

According to another embodiment, an audio decoder for decoding encoded frames to obtain frames of a sampled audio signal, wherein a frame includes a number of time domain audio samples, may have: a redundancy retrieving decoder for decoding the encoded frames to obtain an information on coefficients for a synthesis filter and prediction domain frame spectra; an inverse time-aliasing introducing transformer for transforming the prediction domain frame spectra to the time domain to obtain overlapping prediction domain frames, wherein the inverse time-aliasing introducing transformer is adapted for determining overlapping prediction domain frames from consecutive prediction domain frame spectra; an overlap/add combiner for combining overlapping prediction domain frames to obtain a prediction domain frame in a critically-sampled way; and a predictive synthesis stage for determining the frames of audio samples based on the coefficients and the prediction domain frame.

According to another embodiment, a method for decoding encoded frames to obtain frames of a sampled audio signal, wherein a frame includes a number of time domain audio samples, may have the steps of: decoding the encoded frames to obtain an information on coefficients for a synthesis filter and prediction domain frame spectra; transforming the prediction domain frame spectra to the time domain to obtain overlapping prediction domain frames from consecutive prediction domain frame spectra; combining overlapping prediction domain frames to obtain a prediction domain frame in a critically sampled way; and determining the frame based on the coefficients and the prediction domain frame.

Another embodiment may have a computer program product for performing the above method, when the computer program runs on a computer or processor.

Embodiments of the present invention are based on the finding that a more efficient coding can be carried out, if time-aliasing introducing transforms are used, for example, for TCX encoding. Time aliasing introducing transforms can allow achieving critical sampling while still being able to cross-fade between adjacent frames. For example in one embodiment the modified discrete cosine transform (MDCT=Modified Discrete Cosine Transform) is used for transforming overlapping time domain frames to the frequency domain. Since this particular transform produces only N frequency domain samples for 2N time domain samples, critical sampling can be maintained even though the time domain frames may overlap by 50%. At the decoder or the inverse time-aliasing introducing transform an overlap and add stage may be adapted for combining the time aliased overlapping and back transformed time domain samples in a way, that time domain aliasing cancellation (TDAC=Time Domain Aliasing Cancellation) can be carried out.

Embodiments may be used in the context of a switched frequency domain and time domain coding with low overlap windows, such as for example the AMR-WB+. Embodiments may use an MDCT instead of a non-critically sampled filterbank. In this way the overhead due to non-critical sampling may be advantageously reduced based on the critical sampling property of, for example, the MDCT. Additionally, longer overlaps are possible without introducing additional overhead. Embodiments can provide the advantage that based on the longer overheads, crossover-fading can be carried out more smoothly, in other words, sound quality may be increased at the decoder.

In one detailed embodiment the FFT in the AMR-WB+ TCX-mode may be replaced by an MDCT while keeping functionalities of AMR-WB+, especially the switching between the ACELP mode and the TCX mode based on a closed or open loop decision. Embodiments may use the MDCT in a non-critically sampled fashion for the first TCX frame after an ACELP frame and subsequently use the MDCT in a critically sampled fashion for all subsequent TCX frames. Embodiments may retain the feature of closed loop decision, using the MDCT with low overlap windows similar to the unmodified AMR-WB+, but with longer overlaps. This may provide the advantage of a better frequency response compared to the unmodified TCX windows.

BRIEF DESCRIPTION OF THE DRAWINGS

Embodiments of the present invention will be detailed subsequently referring to the appended drawings, in which:

FIGS. 2*a*-2*j* show equations for an embodiment of a time domain aliasing introducing transform;

DETAILED DESCRIPTION OF THE INVENTION

In the following, embodiments of the present invention will be described in detail. It is to be noted, that the following embodiments shall not limit the scope of the invention, they shall be rather taken as possible realizations or implementations among many different embodiments.

Figure 1:
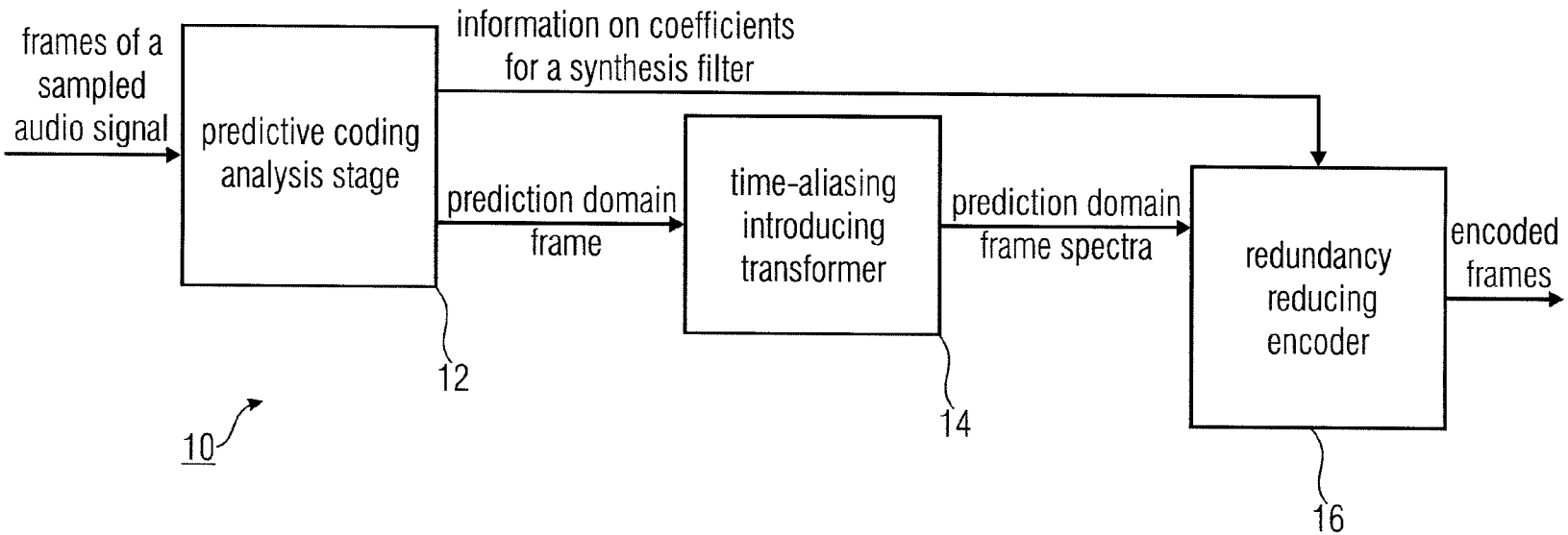
FIG. 1 shows an embodiment of an audio encoder.

FIG. 1 shows an audio encoder 10 adapted for encoding frames of a sampled audio signal to obtain encoded frames, wherein a frame comprises a number of time domain audio samples, the audio encoder 10 comprises a predictive coding analysis stage 12 for determining information on coefficients for a synthesis filter and a prediction domain frame based on frames of audio samples, for example, the prediction domain frame can be based on an excitation frame, the prediction domain frame may comprise samples or weighted samples of an LPC domain signal from which the excitation signal for the synthesis filter can be obtained. In other the words, in embodiments a prediction domain frame can be based on an excitation frame comprising samples of an excitation signal for the synthesis filter. In embodiments the prediction domain frames may correspond to filtered versions of the excitation frames. For example, perceptual filtering may be applied to an excitation frame to obtain the prediction domain frame. In other embodiments high-pass or low-pass filtering may be applied to the excitation frames to obtain the prediction domain frames. In yet another embodiment, the prediction domain frames may directly correspond to excitation frames.

The audio encoder 10 further comprises a time-aliasing introducing transformer 14 for transforming overlapping prediction domain frames to the frequency domain to obtain prediction domain frame spectra, wherein the time-aliasing introducing transformer 14 is adapted for transforming the overlapping prediction domain frames in a critically sampled way. The audio encoder 10 further comprises a redundancy reducing encoder 16 for encoding the prediction domain frame spectra to obtain the encoded frames based on the coefficients and the encoded prediction domain frame spectra.

The redundancy reducing encoder 16 may be adapted for using Huffman coding or entropy coding in order to encode the prediction domain frame spectra and/or the information on the coefficients.

In embodiments the time-aliasing introducing transformer 14 can be adapted for transforming overlapping prediction domain frames such that an average number of samples of a prediction domain frame spectrum equals an average number of samples in a prediction domain frame frame, thereby achieving the critically sampled transform. Furthermore, the time-aliasing introducing transformer 14 can be adapted for transforming overlapping prediction domain frames according to a modified discrete cosine transformation (MDCT=Modified Discrete Cosine Transform).

In the following, the MDCT will be explained in further detail with the help of the equations illustrated in FIGS. 2*a*-2*j*. The modified discrete cosine transform (MDCT) is a Fourier-related transform based on the type-IV discrete cosine transform (DCT-IV=Discrete Cosine Transform type IV), with the additional property of being lapped, i.e. it is designed to be performed on consecutive blocks of a larger dataset, where subsequent blocks are overlapped so that e.g. the last half of one block coincides with the first half of the next block. This overlapping, in addition to the energy-compaction qualities of the DCT, makes the MDCT especially attractive for signal compression applications, since it helps to avoid artifacts stemming from the block boundaries. Thus, an MDCT is employed in MP3 (MP3=MPEG2/4 layer 3), AC-3 (AC-3= Audio Codec 3 by Dolby), Ogg Vorbis, and AAC (AAC= Advanced Audio Coding) for audio compression, for example.

The MDCT was proposed by Princen, Johnson, and Bradley in 1987, following earlier (1986) work by Princen and Bradley to develop the MDCT's underlying principle of time-domain aliasing cancellation (TDAC), further described below. There also exists an analogous transform, the MDST, based on the discrete sine transform, as well as other, rarely used, forms of the MDCT based on different types of DCT or DCT/DST (DST=Discrete Sine Tranform) combinations, which can also be used in embodiments by the time domain aliasing introducing transform 14.

In MP3, the MDCT is not applied to the audio signal directly, but rather to the output of a 32-band polyphase quadrature filter (PQF=Polyphase Quadrature Filter) bank. The output of this MDCT is postprocessed by an alias reduction formula to reduce the typical aliasing of the PQF filter bank. Such a combination of a filter bank with an MDCT is called a hybrid filter bank or a subband MDCT. AAC, on the other hand, normally uses a pure MDCT; only the (rarely used) MPEG-4 AAC-SSR variant (by Sony) uses a four-band PQF bank followed by an MDCT. ATRAC (ATRAC= Adaptive TRansform Audio Coding) uses stacked quadrature mirror filters (QMF) followed by an MDCT.

As a lapped transform, the MDCT is a bit unusual compared to other Fourier-related transforms in that it has half as many outputs as inputs (instead of the same number). In particular, it is a linear function $F: R^{2N} \rightarrow R^{N}$, where R denotes the set of real numbers. The 2N real numbers $x_0, \ldots, x_{2N-1}$ are transformed into the N real numbers $X_0, \ldots, X_{N-1}$ according to the formula in FIG. 2*a*.

The normalization coefficient in front of this transform, here unity, is an arbitrary convention and differs between treatments. Only the product of the normalizations of the MDCT and the IMDCT, below, is constrained.

The inverse MDCT is known as the IMDCT. Because there are different numbers of inputs and outputs, at first glance it might seem that the MDCT should not be invertible. However, perfect invertibility is achieved by adding the overlapped IMDCTs of subsequent overlapping blocks, causing the errors to cancel and the original data to be retrieved; this technique is known as time-domain aliasing cancellation (TDAC).

The IMDCT transforms N real numbers $X_0, \ldots, X_{N-1}$ into 2N real numbers $y_0, \ldots, y_{2N-1}$ according to the formula in FIG. 2*b*. Like for the DCT-IV, an orthogonal transform, the inverse has the same form as the forward transform.

In the case of a windowed MDCT with the usual window normalization (see below), the normalization coefficient in front of the IMDCT should be multiplied by 2 i.e., becoming 2/N.

Although the direct application of the MDCT formula would necessitate $O(N^2)$ operations, it is possible to compute the same thing with only O(N log N) complexity by recursively factorizing the computation, as in the fast Fourier transform (FFT). One can also compute MDCTs via other transforms, typically a DFT (FFT) or a DCT, combined with O(N) pre- and post-processing steps. Also, as described below, any algorithm for the DCT-IV immediately provides a method to compute the MDCT and IMDCT of even size.

In typical signal-compression applications, the transform properties are further improved by using a window function $w_n$ (n=0, . . . , 2N−1) that is multiplied with $x_n$ and $y_n$ in the MDCT and IMDCT formulas, above, in order to avoid discontinuities at the n=0 and 2N boundaries by making the function go smoothly to zero at those points. That is, the data is windowed before the MDCT and after the IMDCT. In principle, x and y could have different window functions, and the window function could also change from one block to the next, especially for the case where data blocks of different sizes are combined, but for simplicity the common case of identical window functions for equal-sized blocks is considered first.

The transform remains invertible, i.e. TDAC works, for a symmetric window $w_n=w_{2N-1-n}$ as long as w satisfies the Princen-Bradley condition according to FIG. 2*c*.

Various different window functions are common, an example is given in FIG. 2*d* for MP3 and MPEG-2 AAC, and in FIG. 2*e* for Vorbis. AC-3 uses a Kaiser-Bessel derived (KBD=Kaiser-Bessel derived) window, and MPEG-4 AAC can also use a KBD window.

Note that windows applied to the MDCT are different from windows used for other types of signal analysis, since they have to fulfill the Princen-Bradley condition. One of the reasons for this difference is that MDCT windows are applied twice, for both the MDCT (analysis filter) and the IMDCT (synthesis filter).

As can be seen by inspection of the definitions, for even N the MDCT is essentially equivalent to a DCT-IV, where the input is shifted by N/2 and two N-blocks of data are transformed at once. By examining this equivalence more carefully, important properties like TDAC can be easily derived.

In order to define the precise relationship to the DCT-IV, one has to realize that the DCT-IV corresponds to alternating even/odd boundary conditions, it is even at its left boundary (around n=−½), odd at its right boundary (around n=N−½), and so on (instead of periodic boundaries as for a DFT). This follows from the identities given in FIG. 2*f*. Thus, if its inputs are an array x of length N, imagine extending this array to $(x, -x_R, -x, x_R, \ldots)$ and so on can be imagined, where $x_R$ denotes x in reverse order.

Consider an MDCT with 2N inputs and N outputs, where the inputs can be divided into four blocks (a, b, c, d) each of size N/2. If these are shifted by N/2 (from the +N/2 term in the MDCT definition), then (b, c, d) extend past the end of the N DCT-IV inputs, so they have to be "folded" back according to the boundary conditions described above.

Thus, the MDCT of 2N inputs (a, b, c, d) is exactly equivalent to a DCT-IV of the N inputs: $(-c_R-d, a-b_R)$, where R denotes reversal as above. In this way, any algorithm to compute the DCT-IV can be trivially applied to the MDCT.

Similarly, the IMDCT formula as mentioned above is precisely ½ of the DCT-IV (which is its own inverse), where the output is shifted by N/2 and extended (via the boundary conditions) to a length 2N. The inverse DCT-IV would simply give back the inputs $(-c_R-d, a-b_R)$ from above. When this is shifted and extended via the boundary conditions, one obtains the result displayed in FIG. 2*g*. Half of the IMDCT outputs are thus redundant.

One can now understand how TDAC works. Suppose that one computes the MDCT of the subsequent, 50% overlapped, 2N block (c, d, e, f). The IMDCT will then yield, analogous to the above: $(c-d_R, d-c_R, e+f_R, e_R+f)/2$. When this is added with the previous IMDCT result in the overlapping half, the reversed terms cancel and one obtains simply (c, d), recovering the original data.

The origin of the term "time-domain aliasing cancellation" is now clear. The use of input data that extend beyond the boundaries of the logical DCT-IV causes the data to be aliased in exactly the same way that frequencies beyond the Nyquist frequency are aliased to lower frequencies, except that this aliasing occurs in the time domain instead of the frequency domain. Hence the combinations $c-d_R$ and so on, which have precisely the right signs for the combinations to cancel when they are added.

For odd N (which are rarely used in practice), N/2 is not an integer so the MDCT is not simply a shift permutation of a DCT-IV. In this case, the additional shift by half a sample means that the MDCT/IMDCT becomes equivalent to the DCT-III/II, and the analysis is analogous to the above.

Above, the TDAC property was proved for the ordinary MDCT, showing that adding IMDCTs of subsequent blocks in their overlapping half recovers the original data. The derivation of this inverse property for the windowed MDCT is only slightly more complicated.

Recall from above that when (a,b,c,d) and (c,d,e,f) are MDCTed, IMDCTed, and added in their overlapping half, we obtain $(c+d_R, c_R+d)/2+(c-d_R, d-c_R)/2=(c,d)$, the original data.

Now, multiplying both the MDCT inputs and the IMDCT outputs by a window function of length 2N is supposed. As above, we assume a symmetric window function, which is therefore of the form $(w, z, z_R, w_R)$, where w and z are length-N/2 vectors and R denotes reversal as before. Then the Princen-Bradley condition can be written $$w^2+z_R^2=(1, 1, \ldots)$$

with the multiplications and additions performed elementwise, or equivalently $$w_R^2+z^2=(1, 1, \ldots)$$

reversing w and z.

Therefore, instead of MDCTing (a,b,c,d), MDCT $(wa, zb, z_Rc, w_Rd)$ is MDCTed with all multiplications performed elementwise. When this is IMDCTed and multiplied again (elementwise) by the window function, the last-N half results as displayed in FIG. 2*h*.

Note that the multiplication by ½ is no longer present, because the IMDCT normalization differs by a factor of 2 in the windowed case. Similarly, the windowed MDCT and IMDCT of (c,d,e,f) yields, in its first-N half according to FIG. 2*i*. When these two halves are added together, the results of FIG. 2*j* are obtained, recovering the original data.

Figure 3A:
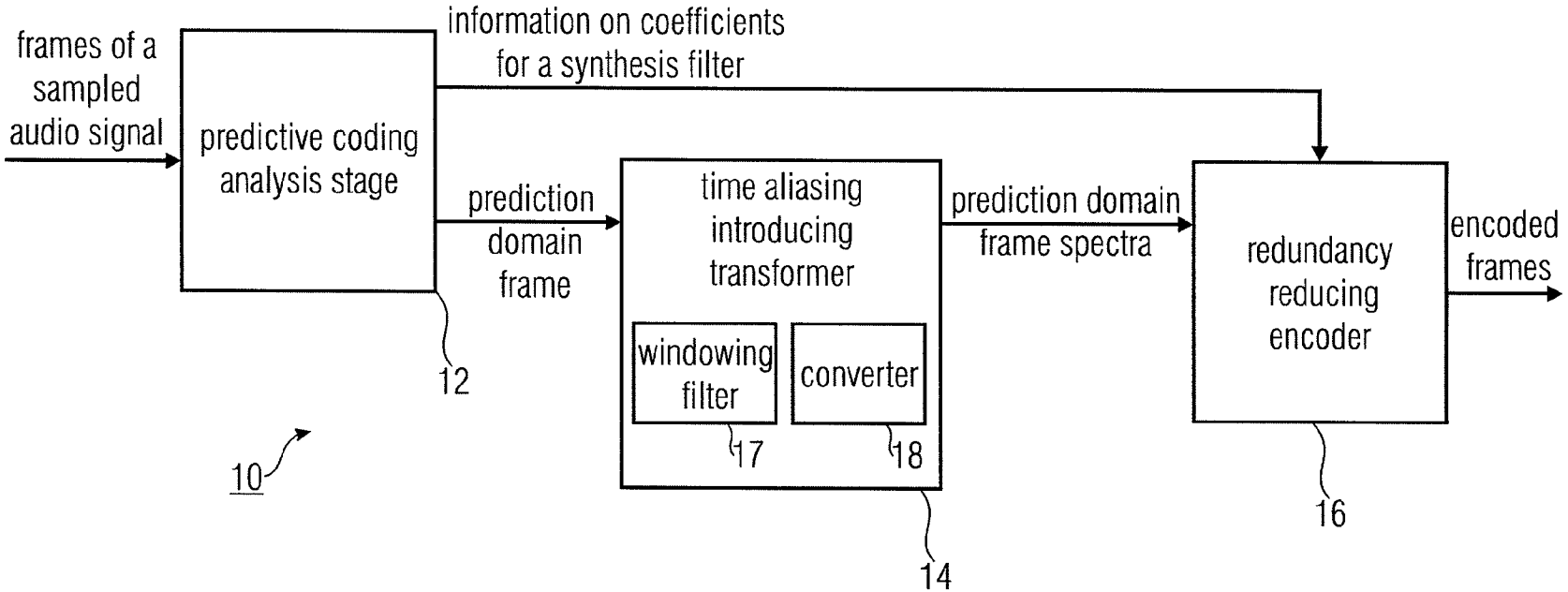
FIG. 3*a* shows another embodiment of an audio encoder.

FIG. 3*a* depicts another embodiment of the audio coder 10. In the embodiment depicted in FIG. 3*a* the time-aliasing introducing transformer 14 comprises a windowing filter 17 for applying a windowing function to overlapping prediction domain frames and a converter 18 for converting windowed overlapping prediction domain frames to the prediction domain spectra. According to the above multiple window functions are conceivable, some of which will be detailed further below.

Figure 3B:
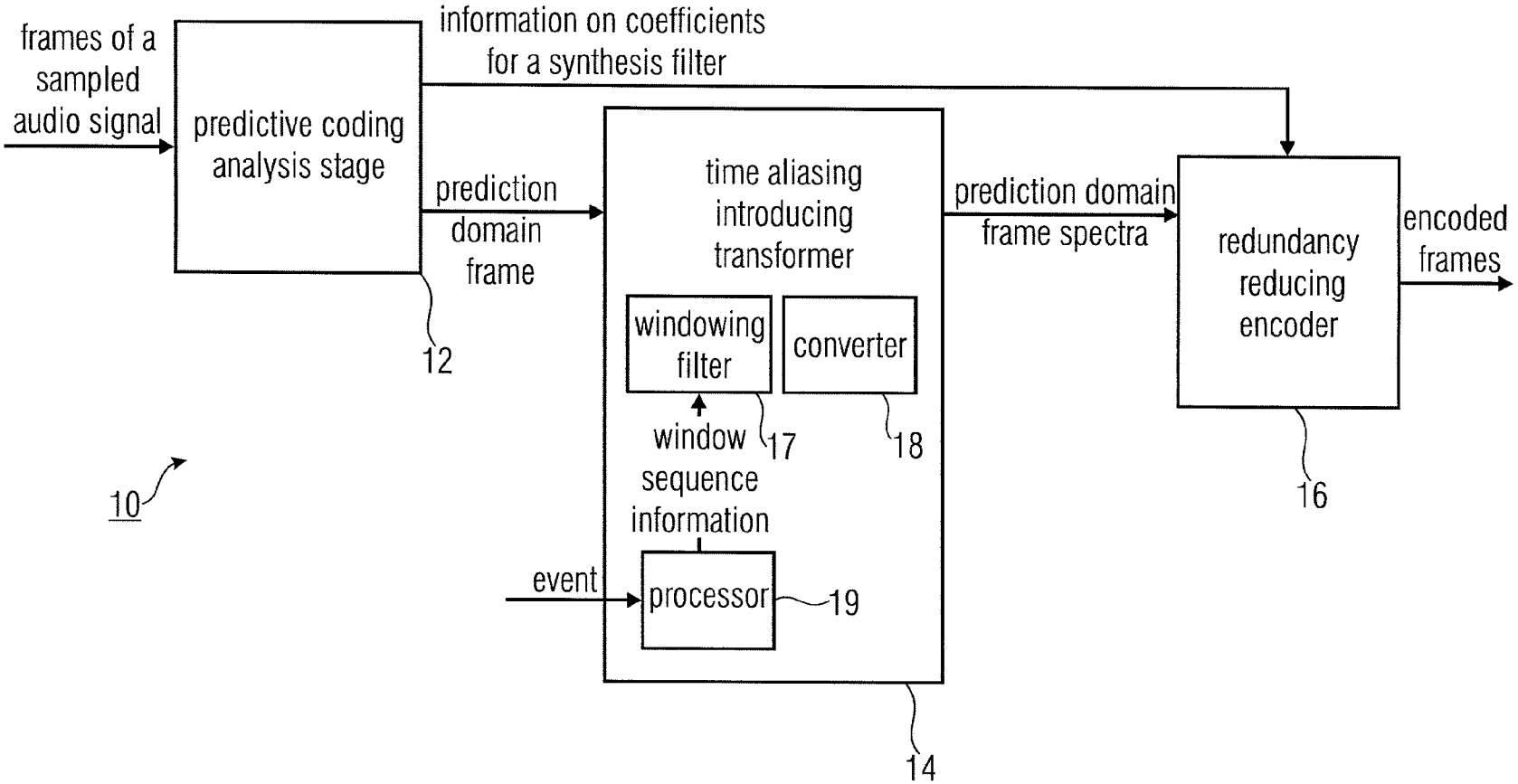
FIG. 3*b* shows another embodiment of an audio encoder.

Another embodiment of an audio encoder 10 is depicted in FIG. 3*b*. In the embodiment depicted in FIG. 3*b* the time-aliasing introducing transformer 14 comprises a processor 19 for detecting an event and for providing a window sequence information if the event is detected and wherein the windowing filter 17 is adapted for applying the windowing function according to the window sequence information. For example, the event may occur dependent on certain signal properties analyzed from the frames of the sampled audio signal. For example different window length or different window edges etc. may be applied according to for example autocorrelation properties of the signal, tonality, transience, etc. In other words, different events may occur as part of different properties of the frames of the sampled audio signal, and the processor 19 may provide a sequence of different windows in dependence on the properties of the frames of the audio signal. More detailed sequences and parameters for window sequences will be set out below.

Figure 3C:
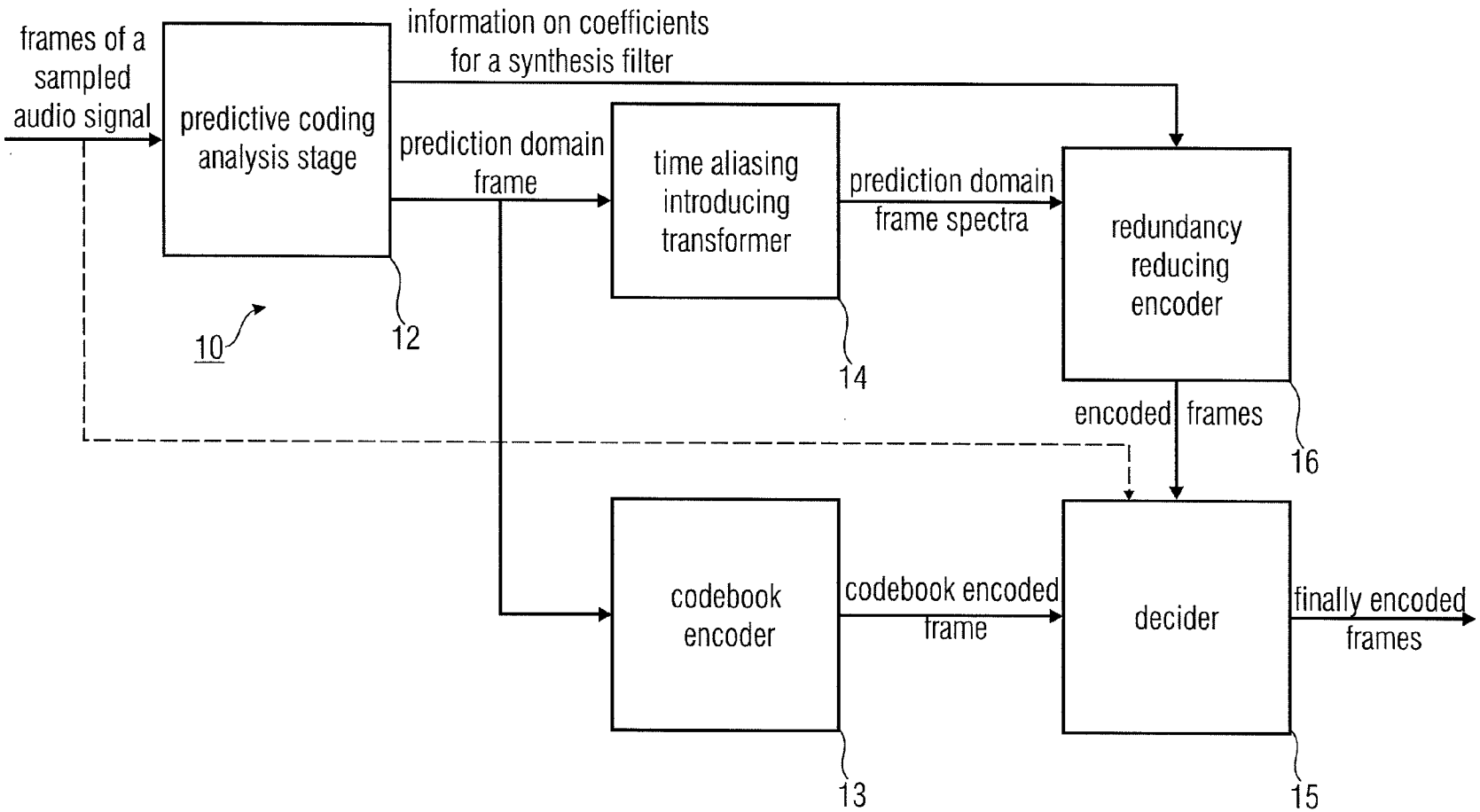
FIG. 3*c* shows yet another embodiment of an audio encoder.

FIG. 3*c* shows another embodiment of an audio encoder 10. In the embodiment depicted in FIG. 3*c* the prediction domain frames are not only provided to the time-aliasing introducing transformer 14 but also to a codebook encoder 13, which is adapted for encoding the prediction domain frames based on a predetermined codebook to obtain a codebook encoded frame. Moreover, the embodiment depicted in FIG. 3*c* comprises a decider for deciding whether to use a codebook encoded frame or encoded frame to obtain a finally encoded frame based on a coding efficiency measure. The embodiment depicted in FIG. 3*c* may also be called a closed loop scenario. In this scenario the decider 15 has the possibility, to obtain encoded frames from two branches, one branch being transformation based the other branch being codebook based. In order to determine a coding efficiency measure, the decider may decode the encoded frames from both branches, and then determine the coding efficiency measure by evaluating error statistics from the different branches.

In other words, the decider 15 may be adapted for reverting the encoding procedure, i.e. carrying out full decoding for both branches. Having fully decoded frames the decider 15 may be adapted for comparing the decoded samples to the original samples, which is indicated by the dotted arrow in FIG. 3*c*. In the embodiment shown in FIG. 3*c* the decider 15 is also provided with the prediction domain frames, therewith it is enabled to decode encoded frames from the redundancy reducing encoder 16 and also decode codebook encoded frames from the codebook encoder 13 and compare the results to the originally encoded prediction domain frames. Therewith, in one embodiment by comparing the differences, coding efficiency measures for example in terms of a signal-to-noise ratio or a statistical error or minimum error, etc. can be determined, in some embodiments also in relation to the respective code rate, i.e. the number of bits necessitated to encode the frames. The decider 15 can then be adapted for selecting either encoded frames from the redundancy reducing encoder 16 or the codebook encoded frames as finally encoded frames, based on the coding efficiency measure.

Figure 3D:
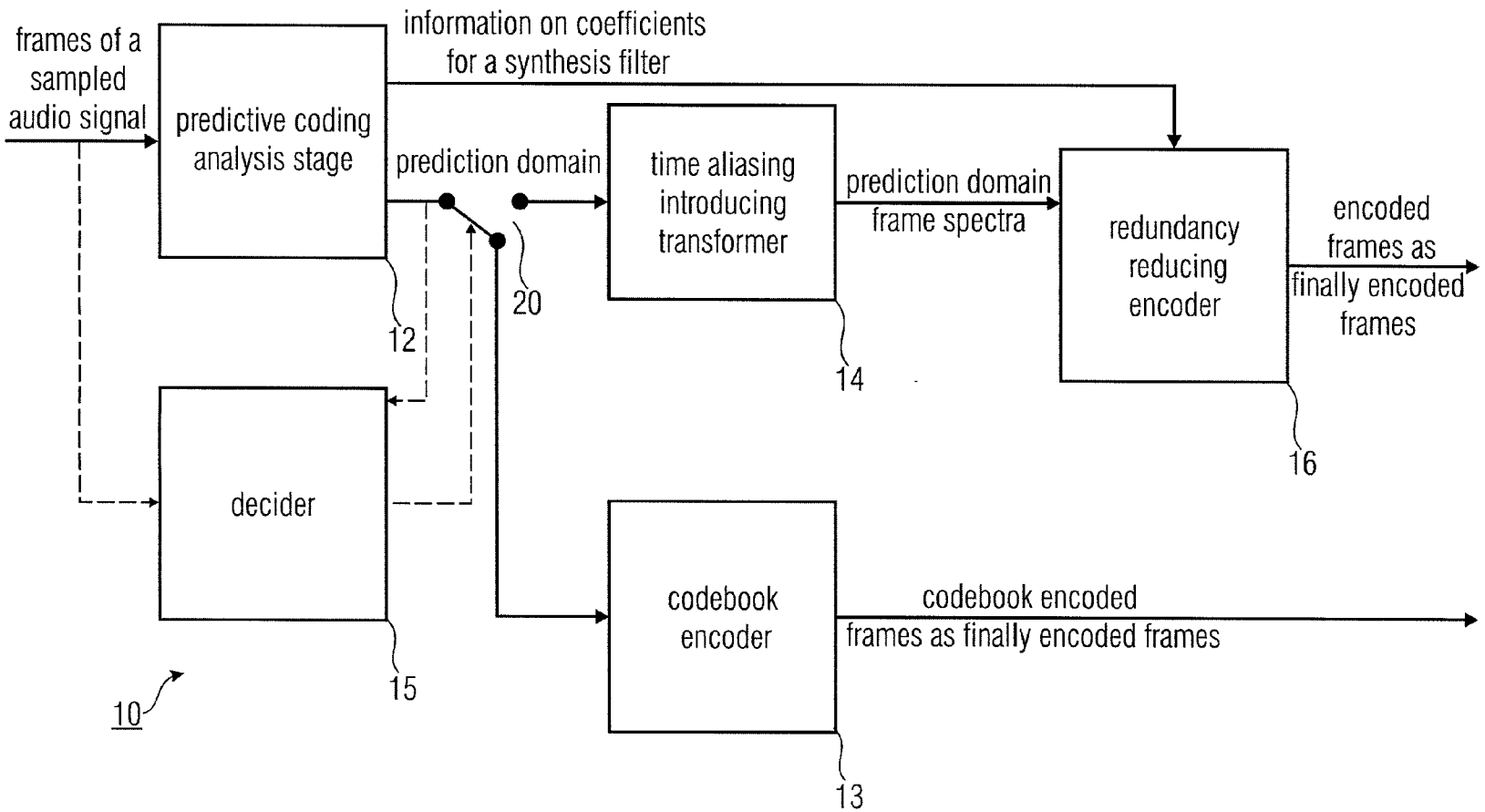
FIG. 3*d* shows yet another embodiment of an audio encoder.

FIG. 3*d* shows another embodiment of the audio encoder 10. In the embodiment shown in FIG. 3*d* there is a switch 20 coupled to the decider 15 for switching the prediction domain frames between the time-aliasing introducing transformer 14 and the codebook encoder 13 based on a coding efficiency measure. The decider 15 can be adapted for determining a coding efficiency measure based on the frames of the sampled audio signal, in order to determine the position of the switch 20, i.e. whether to use the transform-based coding branch with the time-aliasing introducing transformer 14 and the redundancy reducing encoder 16 or the codebook based encoding branch with the codebook encoder 13. As already mentioned above, the coding efficiency measure may be determined based on properties of the frames of the sampled audio signal, i.e. the audio properties themselves, for example whether the frame is more tone-like or noise-like.

The configuration of the embodiment shown in FIG. 3*d* is also called open loop configuration, since the decider 15 may decide based on the input frames without knowing the results of the outcome of the respective coding branch. In yet another embodiment the decider may decide based on the prediction domain frames, which is shown in FIG. 3*d* by the dotted arrow. In other words, in one embodiment, the decider 15 may not decide based on the frames of the sampled audio signal, but rather on the prediction domain frames.

In the following, the decision process of the decider 15 is illuminated. Generally, a differentiation between an impulse-like portion of an audio signal and a stationary portion of a stationary signal can be made by applying a signal processing operation, in which the impulse-like characteristic is measured and the stationary-like characteristic is measured as well. Such measurements can, for example, be done by analyzing the waveform of the audio signal. To this end, any transform-based processing or LPC processing or any other processing can be performed. An intuitive way for determining as to whether the portion is impulse-like or not is for example to look at a time domain waveform and to determine whether this time domain waveform has peaks at regular or irregular intervals, and peaks in regular intervals are even more suited for a speech-like coder, i.e. for the codebook encoder. Note, that even within speech voiced and unvoiced parts can be distinguished. The codebook encoder 13 may be more efficient for voiced signal parts or voiced frames, wherein the transform-based branch comprising the time-aliasing introducing transformer 14 and the redundancy reducing encoder 16 may be more suitable for unvoiced frames. Generally, the transform based coding may also be more suitable for stationary signals other than voice signals.

Figure 4B:
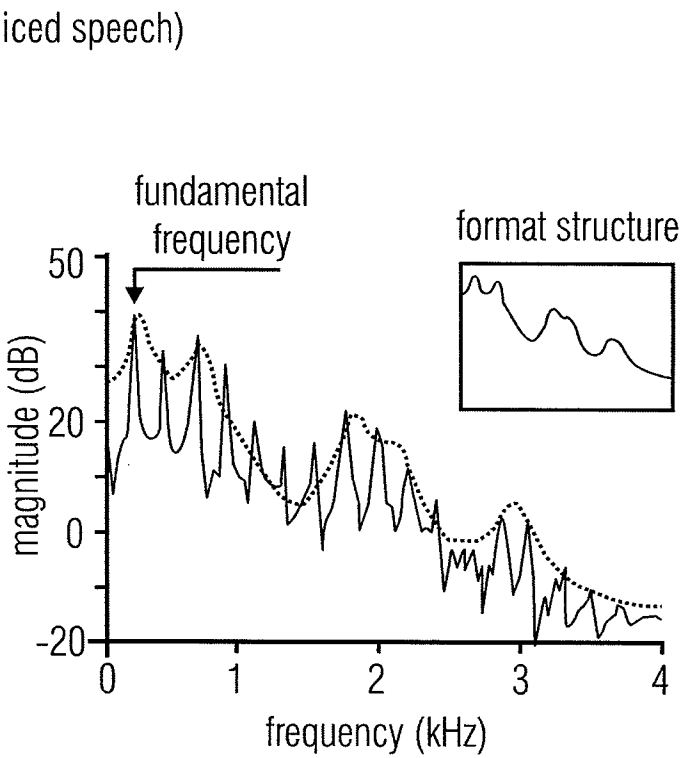
FIG. 4*b* illustrates a spectrum of a voiced speech signal sample.
Figure 4A:
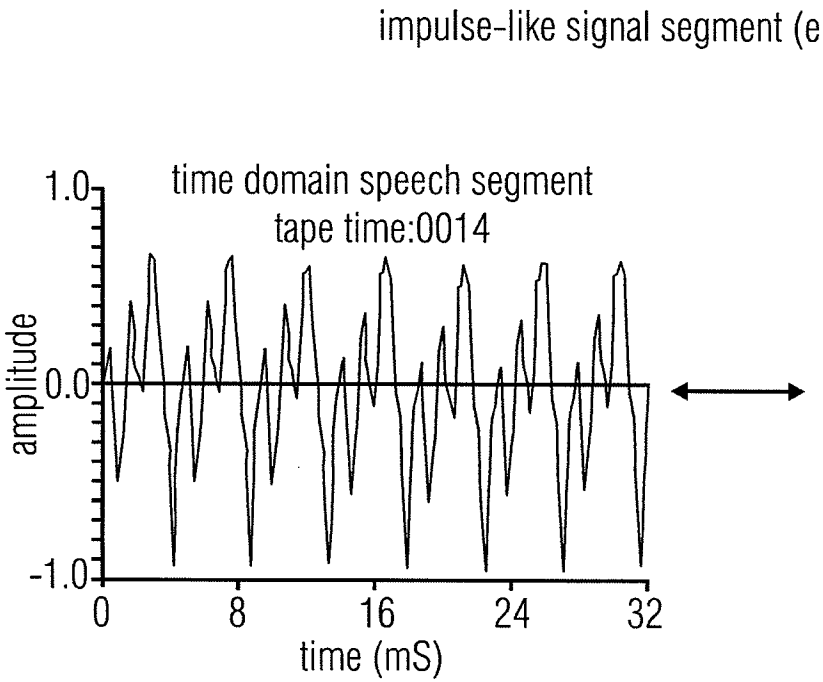
FIG. 4*a* shows a sample of time domain speech signal for voiced speech.

Exemplarily, reference is made to FIGS. 4*a* and 4*b*, 5*a* and 5*b*, respectively. Impulse-like signal segments or signal portions and stationary signal segments or signal portions are exemplarily discussed. Generally, the decider 15 can be adapted for deciding based on different criteria, as e.g. stationarity, transience, spectral whiteness, etc. In the following an example criteria is given as part of an embodiment. Specifically, a voiced speech is illustrated in FIG. 4*a* in the time domain and in FIG. 4*b* in the frequency domain and is discussed as example for an impulse-like signal portion, and an unvoiced speech segment as an example for a stationary signal portion is discussed in connection with FIGS. 5*a* and 5*b*.

Speech can generally be classified as voiced, unvoiced or mixed. Time-and-frequency domain plots for sampled voiced and unvoiced segments are shown in FIGS. 4*a*, 4*b*, 5*a* and 5*b*. Voiced speech is quasi periodic in the time domain and harmonically structured in the frequency domain, while unvoiced speech is random-like and broadband. In addition, the energy of voiced segments is generally higher than the energy of unvoiced segments. The short-term spectrum of voiced speech is characterized by its fine and formant structure. The fine harmonic structure is a consequence of the quasi-periodicity of speech and may be attributed to the vibrating vocal cords. The formant structure, which is also called the spectral envelope, is due to the interaction of the source and the vocal tracts. The vocal tracts consist of the pharynx and the mouth cavity. The shape of the spectral envelope that "fits" the short-term spectrum of voiced speech is associated with the transfer characteristics of the vocal tract and the spectral tilt (6 dB/octave) due to the glottal pulse.

The spectral envelope is characterized by a set of peaks, which are called formants. The formants are the resonant modes of the vocal tract. For the average vocal tract there are 3 to 5 formants below 5 kHz. The amplitudes and locations of the first three formants, usually occurring below 3 kHz are quite important, both, in speech synthesis and perception. Higher formants are also important for wideband and unvoiced speech representations. The properties of speech are related to physical speech production systems as follows. Exciting the vocal tract with quasi-periodic glottal air pulses generated by the vibrating vocal cords produces voiced speech. The frequency of the periodic pulse is referred to as the fundamental frequency or pitch. Forcing air through a constriction in the vocal tract produces unvoiced speech. Nasal sounds are due to the acoustic coupling of the nasal tract to the vocal tract, and plosive sounds are prouduced by abruptly reducing the air pressure, which was built up behind the closure in the tract.

Figures 5A, 5B:
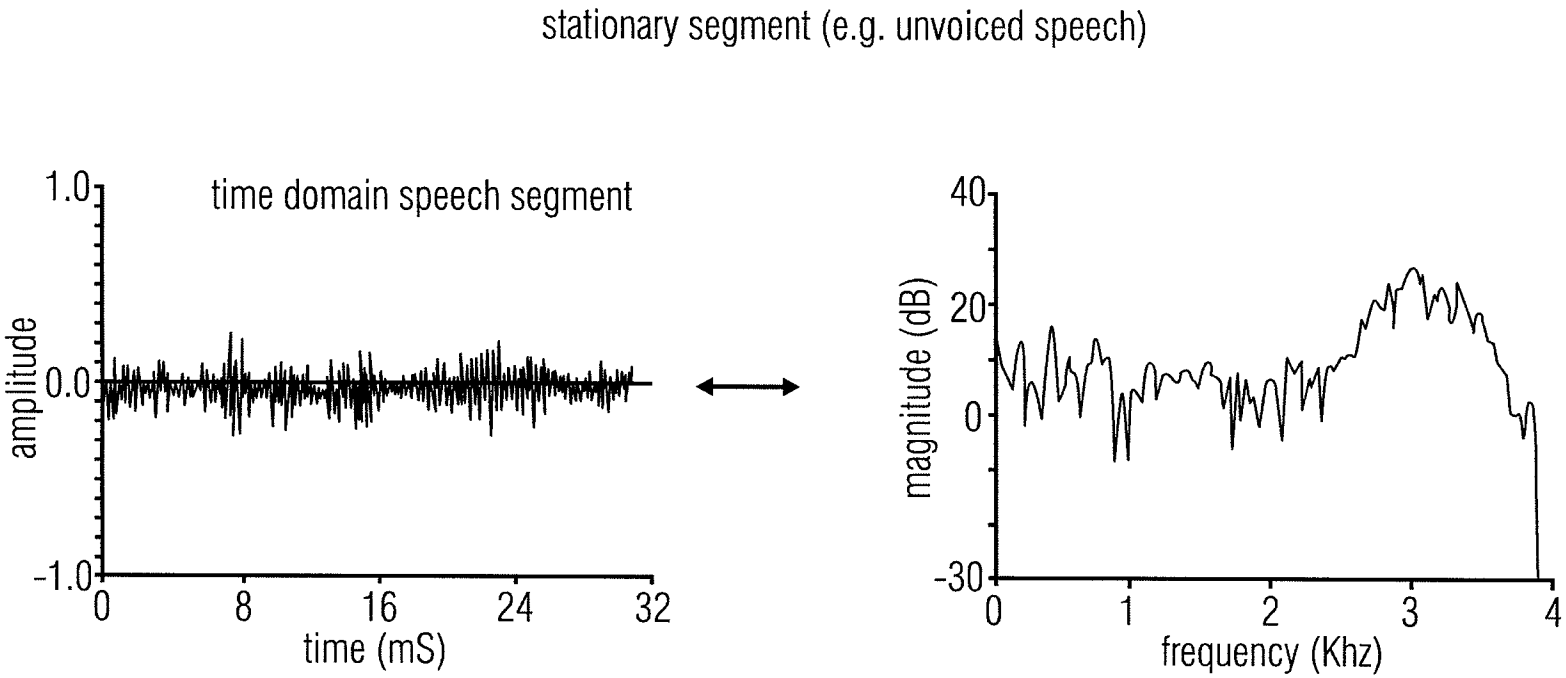
FIG. 5*a* illustrates a time domain signal of a sample of a unvoiced speech.
FIG. 5*b* shows a spectrum of a sample of an unvoiced speech signal.

Thus, a stationary portion of the audio signal can be a stationary portion in the time domain as illustrated in FIG. 5*a* or a stationary portion in the frequency domain, which is different from the impulse-like portion as illustrated for example in FIG. 4*a*, due to the fact that the stationary portion in the time domain does not show permanent repeating pulses. As will be outlined later on, however, the differentiation between stationary portions and impulse-like portions can also be performed using LPC methods, which model the vocal tract and the excitation of the vocal tracts. When the frequency domain of the signal is considered, impulse-like signals show the prominent appearance of the individual formants, i.e., prominent peaks in FIG. 4*b*, while the stationary spectrum has quite a wide spectrum as illustrated in FIG. 5*b*, or in the case of harmonic signals, quite a continuous noise floor having some prominent peaks representing specific tones which occur, for example, in a music signal, but which do not have such a regular distance from each other as the impulse-like signal in FIG. 4*b*.

Furthermore, impulse-like portions and stationary portions can occur in a timely manner, i.e., which means that a portion of the audio signal in time is stationary and another portion of the audio signal in time is impulse-like. Alternatively or additionally, the characteristics of a signal can be different in different frequency bands. Thus, the determination, whether the audio signal is stationary or impulse-like, can also be performed frequency-selective so that a certain frequency band or several certain frequency bands are considered to be stationary and other frequency bands are considered to be impulse-like. In this case, a certain time portion of the audio signal might include an impulse-like portion or a stationary portion.

Coming back to the embodiment shown in FIG. 3*d*, the decider 15 may analyze the audio frames, the prediction domain frames or the excitation signal, in order to determine whether they are rather impulse-like, i.e. more suitable for the codebook encoder 13, or stationary, i.e. more suitable for the transform-based encoding branch.

Figure 6:
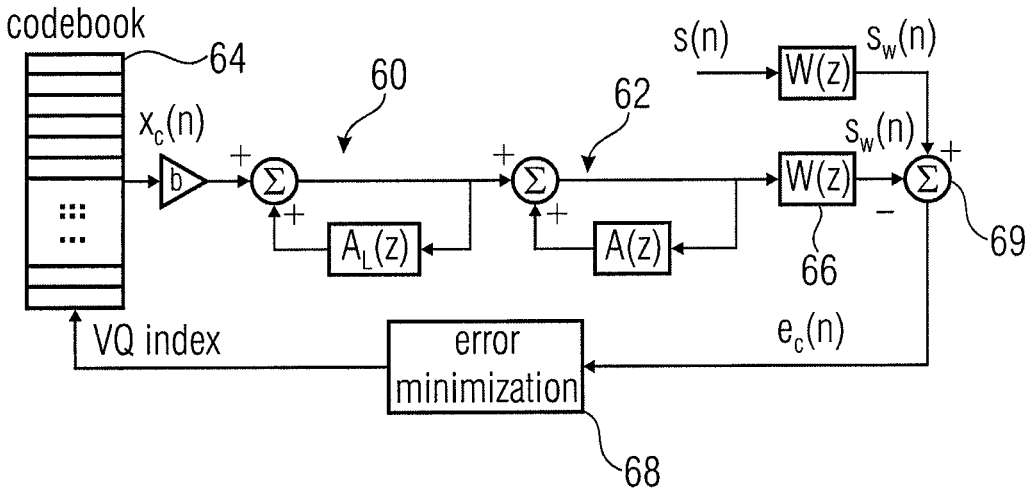
FIG. 6 shows an embodiment of an analysis-by-synthesis CELP.

Subsequently, an analysis-by-synthesis CELP encoder will be discussed with respect to FIG. 6. Details of a CELP encoder can be also found in "Speech Coding: A tutorial review", Andreas Spaniers, Proceedings of IEEE, Vol. 84, No. 10, October 1994, pp. 1541-1582. The CELP encoder as illustrated in FIG. 6 includes a long-term prediction component 60 and a short-term prediction component 62. Furthermore, a codebook is used which is indicated at 64. A perceptual weighting filter W(z) is implemented at 66, and an error minimization controller is provided at 68. s(n) is the input audio signal. After having been perceptually weighted, the weighted signal is input into a subtractor 69, which calculates the error between the weighted synthesis signal (output of block 66) and the actual weighted prediction signal $s_w(n)$.

Generally, the short-term prediction A(z) is calculated by an LPC analysis stage which will be further discussed below. Depending on this information, the long-term prediction $A_L(z)$ includes the long-term prediction gain b and delay T (also known as pitch gain and pitch delay). The CELP algorithm encodes the excitation or prediction domain frames using a codebook of for example Gaussian sequences. The ACELP algorithm, where the "A" stands for "algebraic" has a specific algebraically designed codebook.

The codebook may contain more or less vectors where each vector has a length according to a number of samples. A gain factor g scales the excitation vector and the excitation samples are filtered by the long-term synthesis filter and a short-term synthesis filter. The "optimum" vector is selected such that the perceptually weighted mean square error is minimized. The search process in CELP is evident from the analysis-by-synthesis scheme illustrated in FIG. 6. It is to be noted, that FIG. 6 only illustrates an example of an analysis-by-synthesis CELP and that embodiments shall not be limited to the structure shown in FIG. 6.

In CELP, the long-term predictor is often implemented as an adaptive codebook containing the previous excitation signal. The long-term prediction delay and gain are represented by an adaptive codebook index and gain, which are also selected by minimizing the mean square weighted error. In this case the excitation signal consists of the addition of two gain-scaled vectors, one from an adaptive codebook and one from a fixed codebook. The perceptual weighting filter in AMR-WB+ is based on the LPC filter, thus the perceptually weighted signal is a form of an LPC domain signal. In the transform domain coder used in AMR-WB+, the transform is applied to the weighted signal. At the decoder, the excitation signal is obtained by filtering the decoded weighted signal through a filter consisting of the inverse of synthesis and weighting filters.

A reconstructed TCX target x(n) may be filtered through a zero-state inverse weighted synthesis filter $$\frac{\hat{A}(z)(1-\alpha z^{-1})}{(\hat{A}(z/\lambda))}$$

to find the excitation signal which can be applied to the synthesis filter. Note that the interpolated LP filter per subframe or frame is used in the filtering. Once the excitation is determined, the signal can be reconstructed by filtering the excitation through synthesis filter $1/\hat{A}(z)$ and then de-emphasizing by for example filtering through the filter $1/(1-0.68z^{-1})$. Note that the excitation may also be used to update the ACELP adaptive codebook and allows to switch from TCX to ACELP in a subsequent frame. Note also that the length of the TCX synthesis can be given by the TCX frame length (without the overlap): 256, 512 or 1024 samples for the mod [ ] of 1, 2 or 3 respectively.

The functionality of an embodiment of the predictive coding analysis stage 12 will be discussed subsequently according to the embodiment shown in FIG. 7, using LPC analysis and LPC synthesis in the decider 15, in the according embodiments.

Figure 7:
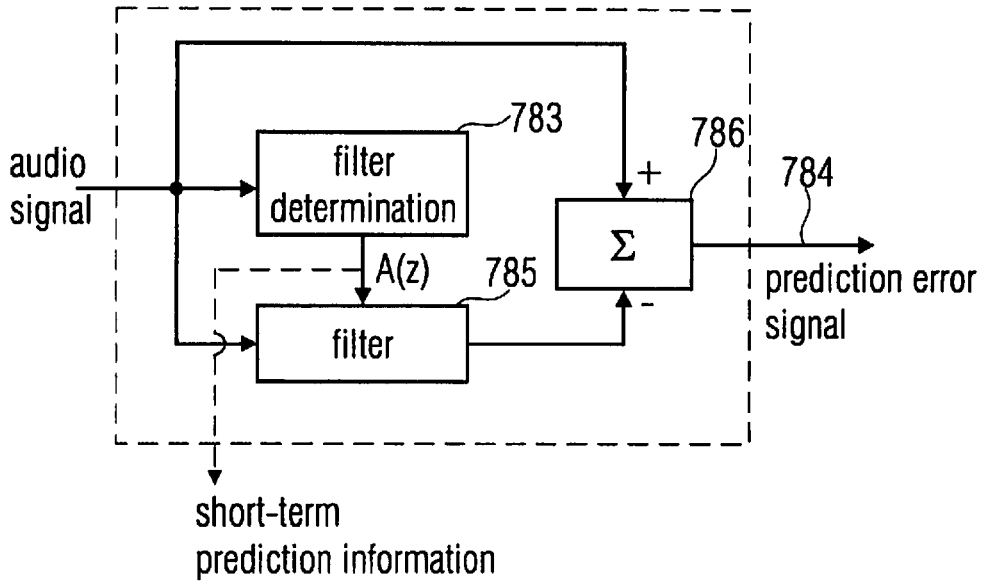
FIG. 7 illustrates an encoder-side ACELP stage providing short-term prediction information and a prediction error signal.

FIG. 7 illustrates a more detailed implementation of an embodiment of an LPC analysis block 12. The audio signal is input into a filter determination block 783, which determines the filter information A(z), i.e. the information on coefficients for the synthesis filter 785. This information is quantized and output as the short-term prediction information necessitated for the decoder. In a subtractor 786, a current sample of the signal is input and a predicted value for the current sample is subtracted so that for this sample, the prediction error signal is generated at line 784. Note that the prediction error signal may also be called excitation signal or excitation frame (usually after being encoded).

Figure 8A:
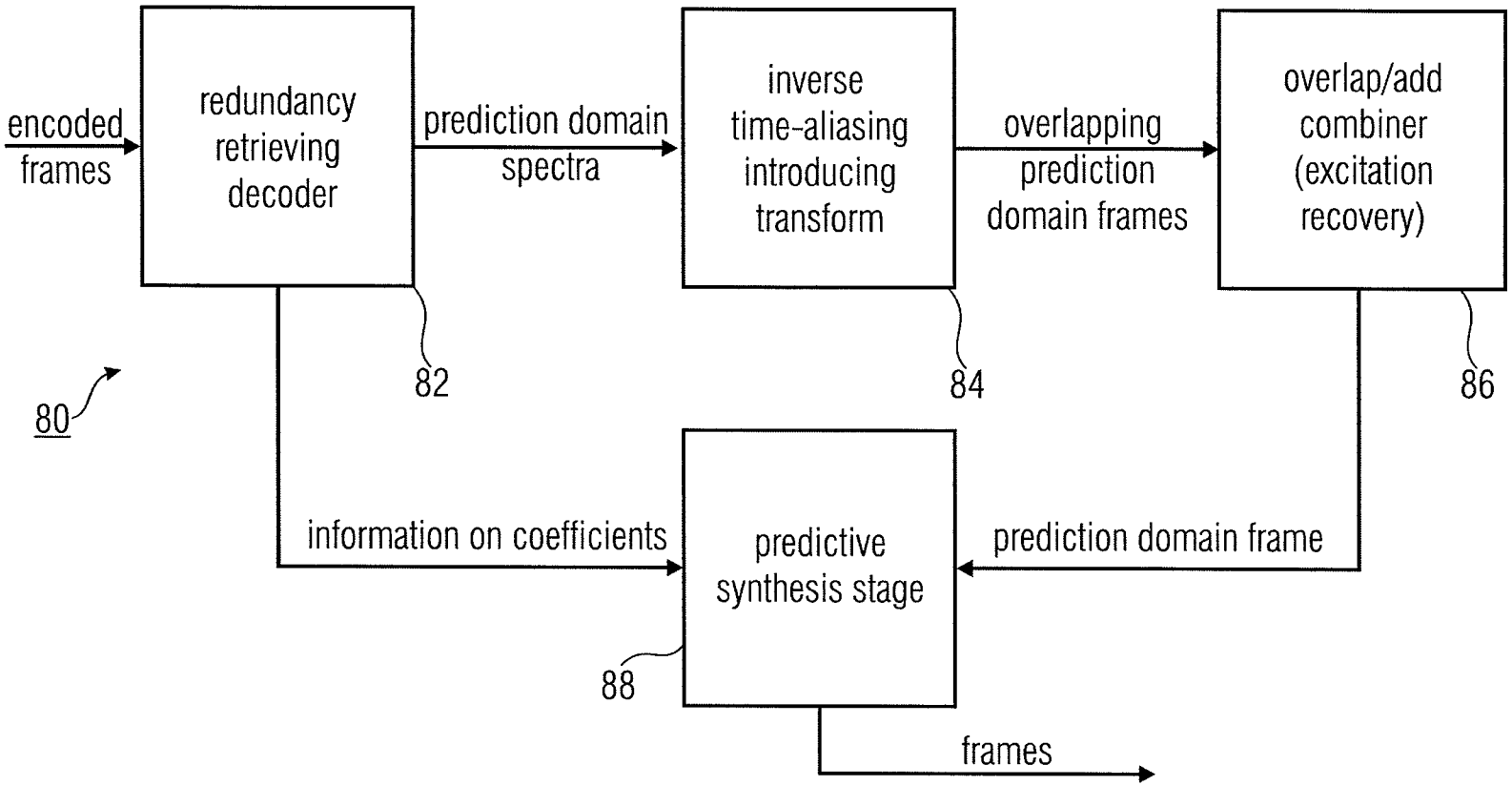
FIG. 8*a* shows an embodiment of an audio decoder.

An embodiment of an audio decoder 80 for decoding encoded frames to obtain frames of a sampled audio signal, wherein a frame comprises a number of time domain samples, is shown in FIG. 8*a*. The audio decoder 80 comprises a redundancy retrieving decoder 82 for decoding the encoded frames to obtain information on coefficients for a synthesis filter and prediction domain frame spectra, or prediction spectral domain frames. The audio decoder 80 further comprises an inverse time-aliasing introducing transformer 84 for transforming the prediction spectral domain frame to the time domain to obtain overlapping prediction domain frames, wherein the inverse time-aliasing introducing transformer 84 is adapted for determining overlapping prediction domain frames from consecutive prediction domain frame spectra. Moreover, the audio decoder 80 comprises an overlap/add combiner 86 for combining overlapping prediction domain frames to obtain a prediction domain frame in a critically sampled way. The prediction domain frame may consist of the LPC-based weighted signal. The overlap/add combiner 86 may also include a converter for converting prediction domain frames into excitation frames. The audio decoder 80 further comprises a predictive synthesis stage 88 for determining the synthesis frame based on the coefficients and the excitation frame.

The overlap and add combiner 86 can be adapted for combining overlapping prediction domain frames such that an average number of samples in an prediction domain frame equals an average number of samples of the prediction domain frame spectrum. In embodiments the inverse time-aliasing introducing transformer 84 can be adapted for transforming the prediction domain frame spectra to the time domain according to an IMDCT, according to the above details.

Figure 8B:
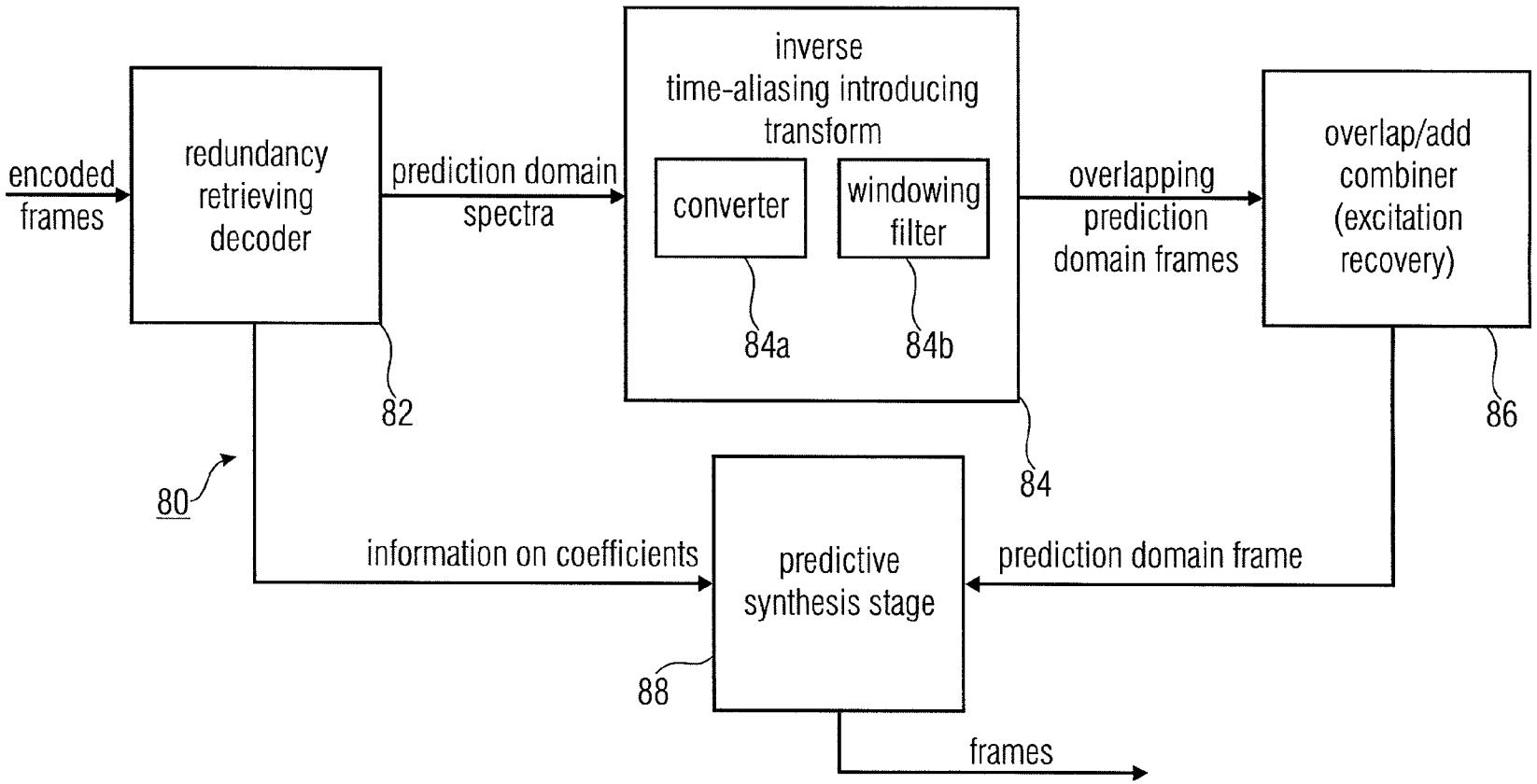
FIG. 8*b* shows another embodiment of an audio decoder.
Figure 8C:
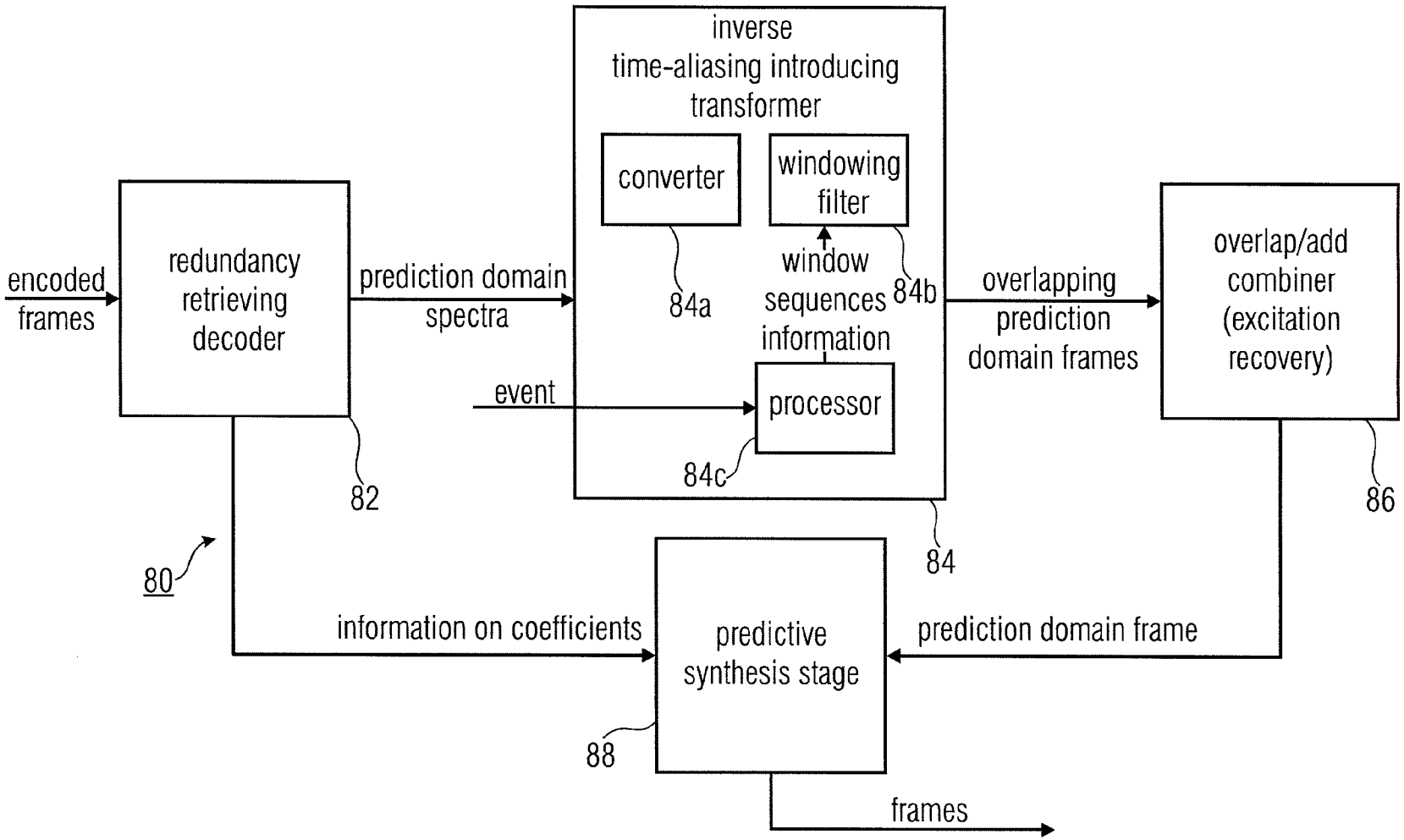
FIG. 8*c* shows another embodiment of an audio decoder.

Generally in block 86, after "overlap/add combiner" there may in embodiments optionally be an "excitation recovery", which is indicated in brackets in FIGS. 8*a-c*. In embodiments the overlap/add may be carried out in the LPC weighted domain, then the weighted signal may be converted to the excitation signal by filtering through the inverse of the weighted synthesis filter.

Moreover, in embodiments, the predictive synthesis stage 88 can be adapted for determining the frame based on linear prediction, i.e. LPC. Another embodiment of an audio decoder 80 is depicted in FIG. 8*b*. The audio decoder 80 depicted in FIG. 8*b* shows similar components as the audio decoder 80 depicted in FIG. 8*a*, however, the inverse time-aliasing introducing transformer 84 in the embodiment shown in FIG. 8*b* further comprises a converter 84*a* for converting prediction domain frame spectra to converted overlapping prediction domain frames and a windowing filter 84*b* for applying a windowing function to the converted overlapping prediction domain frames to obtain the overlapping prediction domain frames.

FIG. 8*c* shows another embodiment of an audio decoder 80 having similar components as in the embodiment depicted in FIG. 8*b*. In the embodiment depicted in FIG. 8*c* the inverse time-aliasing introducing transformer 84 further comprises a processor 84*c* for detecting an event and for providing a window sequence information if the event is detected to the windowing filter 84*b* and the windowing filter 84*b* is adapted for applying the windowing function according to the window sequence information. The event may be an indication derived from or provided by the encoded frames or any side information.

Figure 9:
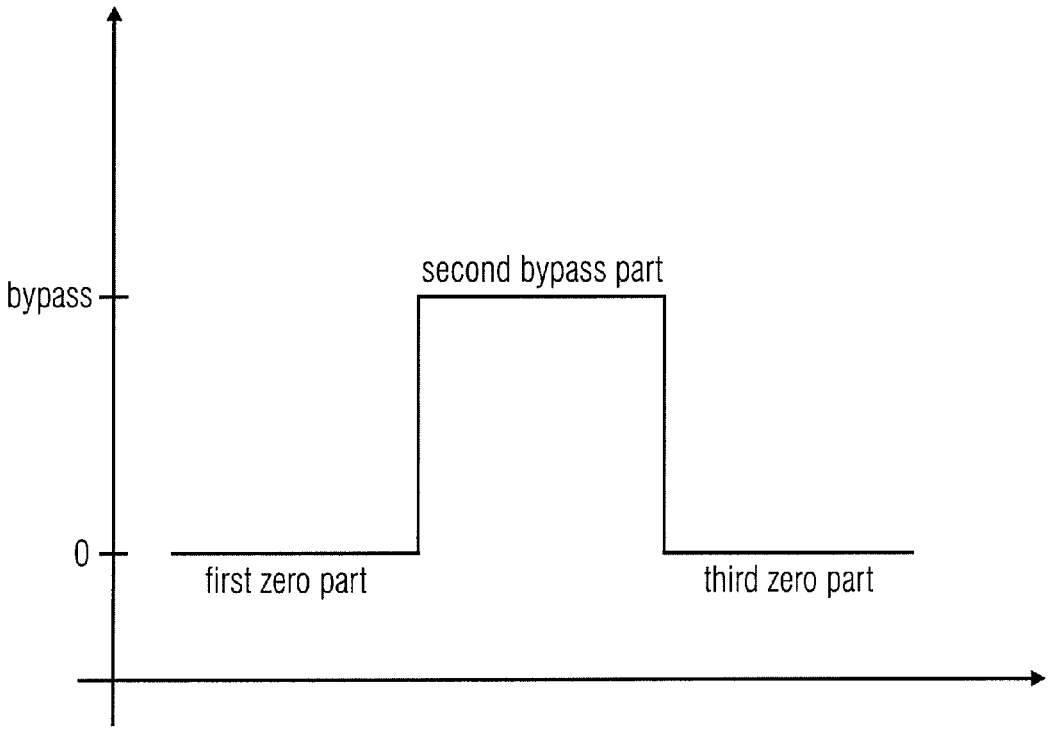
FIG. 9 shows an embodiment of a window function.

In embodiments of audio encoders 10 and audio decoders 80, the respective windowing filters 17 and 84*b* can be adapted for applying windowing functions according to window sequence information. FIG. 9 depicts a general rectangular window, in which the window sequence information may comprise a first zero part, in which the window masks samples, a second bypass part, in which the samples of a frame, i.e. a prediction domain frame or an overlapping prediction domain frame, may be passed through unmodified, and a third zero part, which again masks samples at the end of a frame. In other words, windowing functions may be applied, which suppress a number of samples of a frame in a first zero part, pass through samples in a second bypass part, and then suppress samples at the end of a frame in a third zero part. In this context suppressing may also refer to appending a sequence of zeros at the beginning and/or end of the bypass part of the window. The second bypass part may be such, that the windowing function simply has a value of 1, i.e. the samples are passed through unmodified, i.e. the windowing function switches through the samples of the frame.

Figure 10:
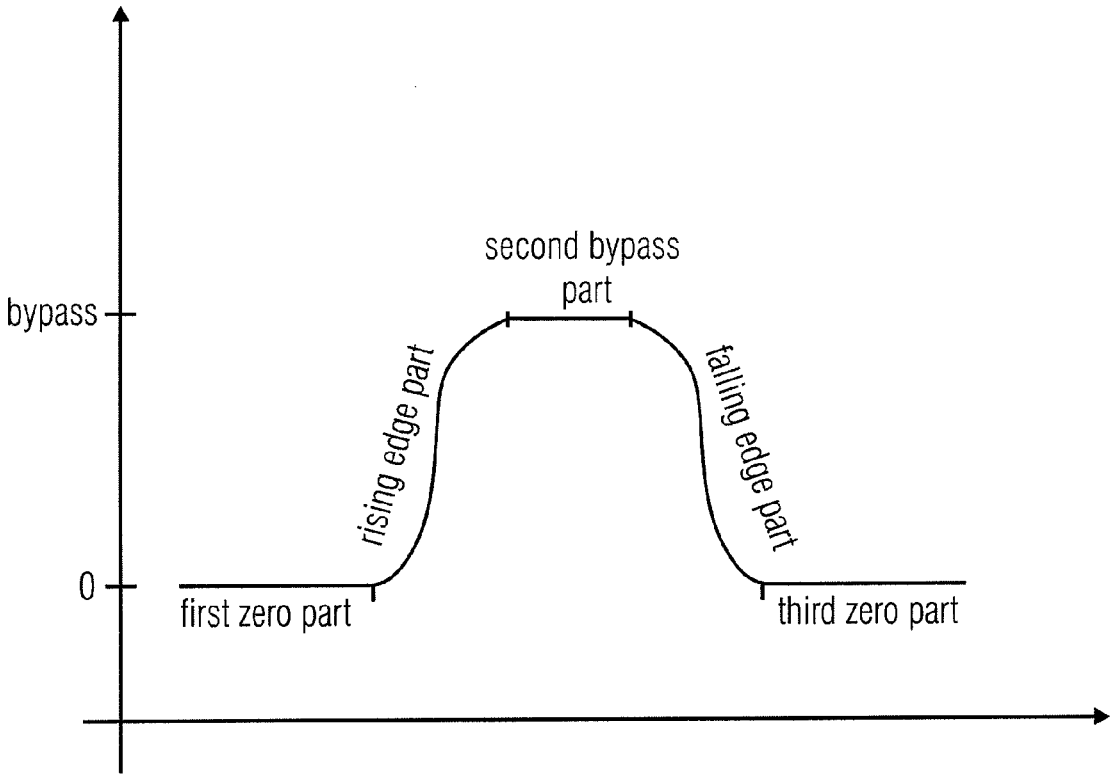
FIG. 10 shows another embodiment of a window function.

FIG. 10 shows another embodiment of a windowing sequence or windowing function, wherein the windowing sequence further comprises a rising edge part between the first zero part and the second bypass part and a falling edge part between the second bypass part and the third zero part. The rising edge part can also be considered as a fade-in part and the falling edge part can be considered as a fade-out part. In embodiments, the second bypass part may comprise a sequence of ones for not modifying the samples of the LPC domain frame at all.

In other words, the MDCT-based TCX may request from the arithmetic decoder a number of quantized spectral coefficients, lg, which is determined by the mod [ ] and last_lpd_mode values of the last mode. These two values may also define the window length and shape which will be applied in the inverse MDCT. The window may be composed of three parts, a left side overlap of L samples, a middle part of ones of M samples and a right overlap part of R samples. To obtain an MDCT window of length 2*lg, ZL zeros can be added on the left and ZR zeros on the right side.

The following table shall illustrate the number of spectral coefficients as a function of last_lpd_mode and mod [ ] for some embodiments:

| Value of last_lpd_mode | Value of mod[x] | Number lg of Spectral coefficients | ZL | L | M | R | ZR |
|---|---|---|---|---|---|---|---|
| 0 | 1 | 320 | 160 | 0 | 256 | 128 | 96 |
| 0 | 2 | 576 | 288 | 0 | 512 | 128 | 224 |
| 0 | 3 | 1152 | 512 | 128 | 1024 | 128 | 512 |

-continued

| Value of last_lpd_mode | Value of mod[x] | Number lg of Spectral coefficients | ZL | L | M | R | ZR |
|---|---|---|---|---|---|---|---|
| 1..3 | 1 | 256 | 64 | 128 | 128 | 128 | 64 |
| 1..3 | 2 | 512 | 192 | 128 | 384 | 128 | 192 |
| 1..3 | 3 | 1024 | 448 | 128 | 896 | 128 | 448 |

The MDCT window is given by $$W(n) = \begin{cases} 0 & \text{for } 0 \le n < ZL \\ W_{SIN_LEFT,L}(n - ZL) & \text{for } ZL \le n < ZL + L \\ 1 & \text{for } ZL + L \le n < ZL + L + M \\ W_{SIN_RIGHT,R}(n - ZL - L - M) & \text{for } ZL + L + M \le n < ZL + L + M + R \\ 0 & \text{for } ZL + L + M + R \le n < 21g. \end{cases}$$

Figure 11:
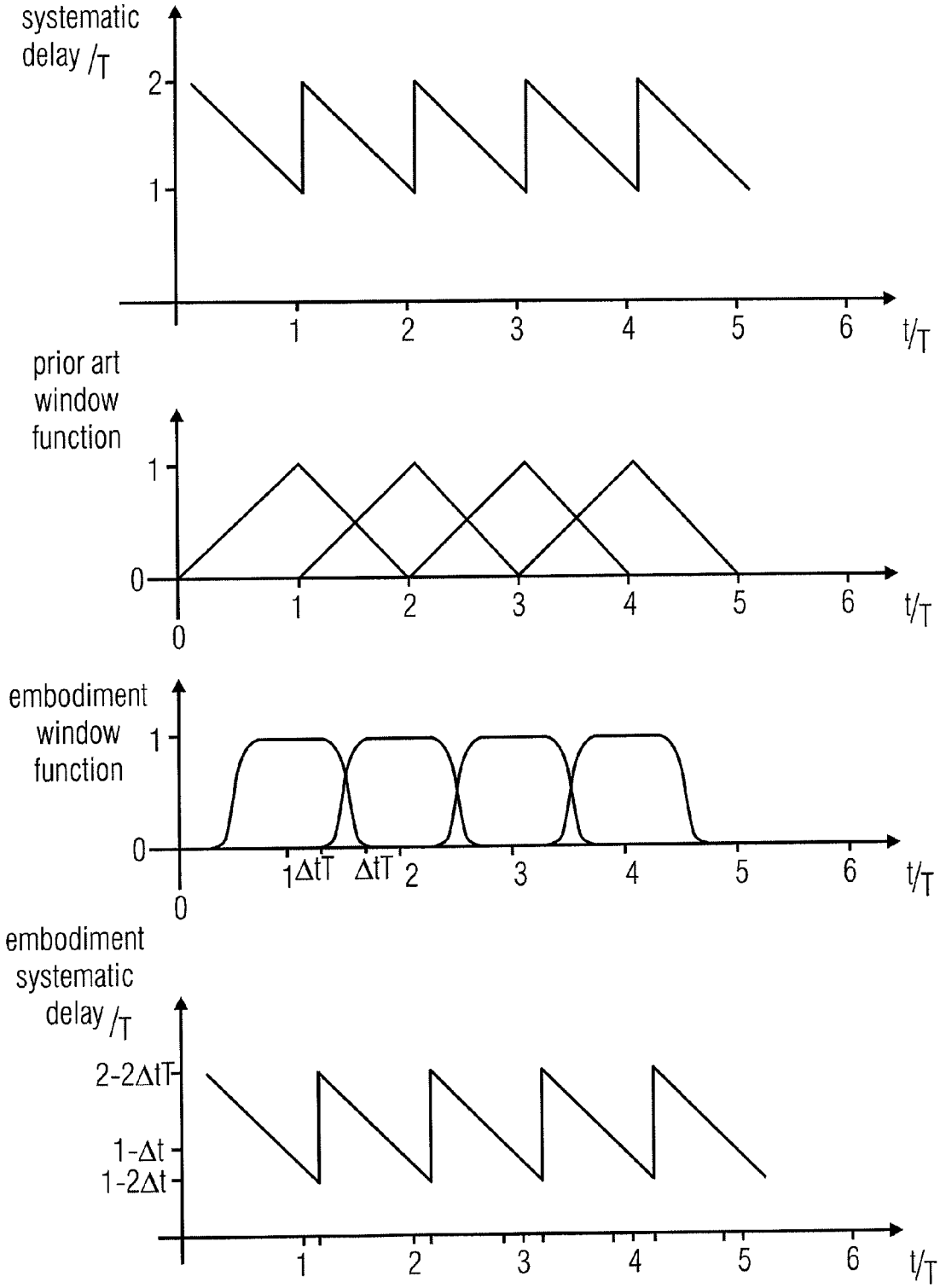
FIG. 11 shows view graphs and delay charts of conventional window functions and a window function of an embodiment.

Embodiments may provide the advantage, that a systematic coding delay of the MDCT, IDMCT respectively, may be lowered when compared to the original MDCT, through application of different window functions. In order to provide more details on this advantage, FIG. 11 shows four view graphs, in which the first one at the top shows a systematic delay in time units T based on traditional triangular shaped windowing functions used with MDCT, which are shown in the second view graph from the top in FIG. 11.

The systematic delay considered here, is the delay a sample has experienced, when it reaches the decoder stage, assuming that there is no delay for encoding or transmitting the samples. In other words, the systematic delay shown in FIG. 11 considers the encoding delay evoked by accumulating the samples of a frame before encoding can be started. As explained above, in order to decode the sample at T, the samples between 0 and 2 T have to be transformed. This yields a systematic delay for the sample at T of another T. However, before the sample shortly after this sample can be decoded, all the samples of the second window, which is centered at 2 T have to be available. Therefore, the systematic delay jumps to 2 T and falls back to T at the center of the second window. The third view graph from the top in FIG. 11 shows a sequence of window functions as provided by an embodiment. It can be seen when compared to the state of the art windows in the second view chart from the top in FIG. 11 that the overlapping areas of the non-zero part of the windows have been reduced by 2Δt. In other words, the window functions used in the embodiments are as broad or wide as the conventional windows, however have a first zero part and a third zero part, which becomes predictable.

In other words, the decoder already knows that there is a third zero part and therefore decoding can be started earlier, encoding respectively. Therefore, the systematic delay can be reduced by 2Δt as is shown at the bottom of FIG. 11. In other words, the decoder does not have to wait for the zero parts, which can save 2Δt. It is evident that of course after the decoding procedure, all samples have to have the same systematic delay. The view graphs in FIG. 11 just demonstrate the systematic delay that a sample experiences until it reaches the decoder. In other words, an overall systematic delay after decoding would be 2 T for the conventional approach, and 2 T-2Δt for the windows in the embodiment.

Figure 12:
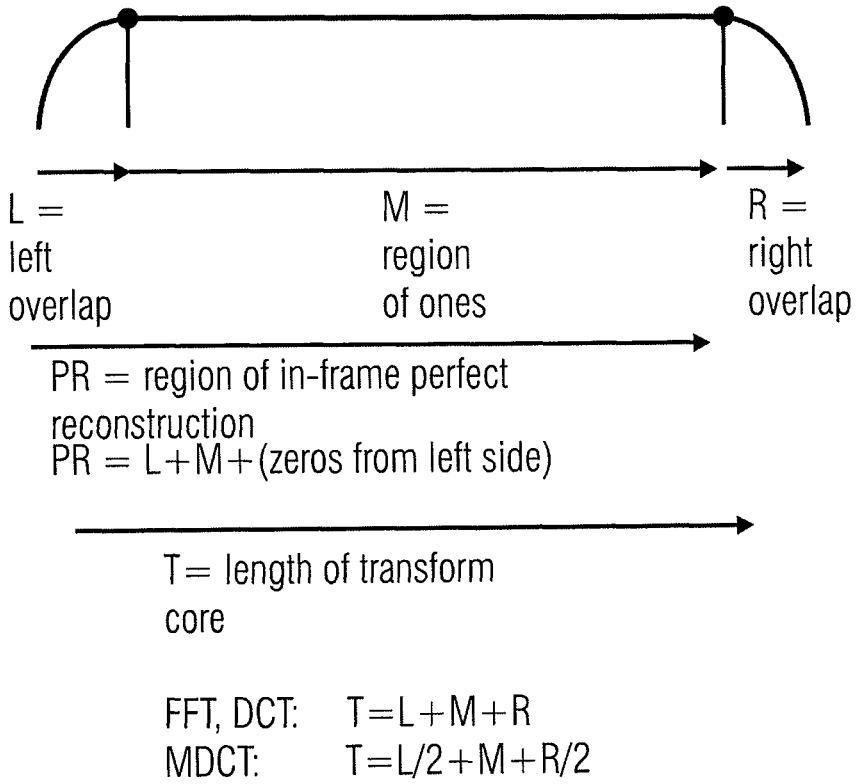
FIG. 12 illustrates window parameters.

In the following an embodiment will be considered, where the MDCT is used in the AMR-WB+ codec, replacing the FFT. Therefore, the windows will be detailed, according to FIG. 12, which defines "L" as left overlap area or rising edge part, "M" the regions of ones or the second bypass part and "R" the right overlap area or the falling edge part. Moreover, the first zero and the third zero parts are considered. Therewith, a region of in-frame perfect reconstruction, which is labeled "PR" is indicated in FIG. 12 by the arrow. Moreover, "T" indicates the arrow of the length of the transform core, which corresponds to the number of frequency domain samples, i.e. half of the number of time domain samples, which are comprised of the first zero part, the rising edge part "L", the second bypass part "M", the falling edge part "R", and the third zero part. Therewith, the number of frequency samples can be reduced when using the MDCT, where the number of frequency samples for the FFT or the discrete cosine transform (DCT=Discrete Cosine Transform)

$$T=L+M+R$$

as compared to the transform coder length for MDCT $$T=L/2+M+R/2.$$

Figure 13A:
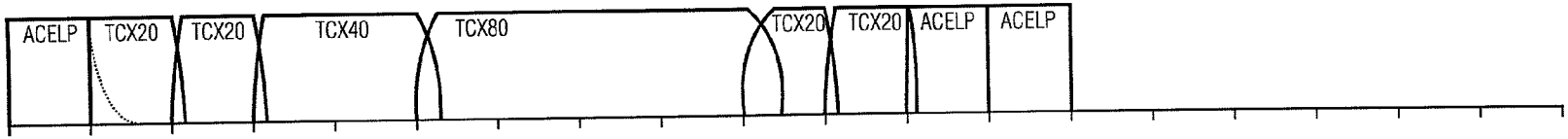
FIG. 13*a* shows a sequence of window functions and a corresponding table of window parameters.

FIG. 13*a* illustrates at the top a view graph of an example sequence of window functions for AMR-WB+. From the left to the right the view graph at the top of FIG. 13*a* shows an ACELP frame, TCX20, TCX20, TCX40, TCX80, TCX20, TCX20, ACELP and ACELP. The dotted line shows the zero-input response as already described above.

At the bottom of FIG. 13*a* there is a table of parameters for the different window parts, where in this embodiment the left overlapping part or the rising edge part L=128 when any TCXx frame follows another TCXx frame. When an ACELP frame follows a TCXx frame, similar windows are used. If a TCX20 or TCX40 frame follows a ACELP frame, then the left overlapping part can be neglected, i.e. L=0. When transmitting from ACELP to TCX80, an overlapping part of L=128 can be used. From the view graph in the table in FIG. 13*a* it can be seen that the basic principle is to stay in non-critical sampling for as long as there is enough overhead for an in-frame perfect reconstruction, and switch to critical sampling as soon as possible. In other words, only the first TCX frame after an ACELP frame remains non-critically sampled with the present embodiment.

Figure 19:
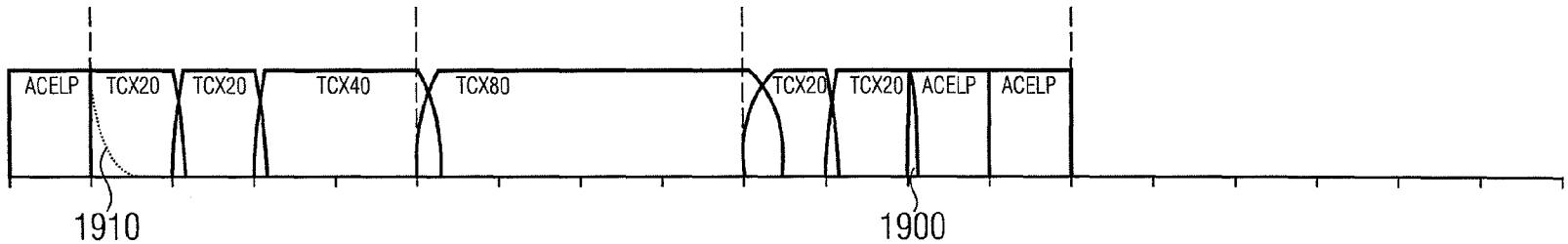
FIG 19 (PRIOR ART)
FIG. 19 illustrates a conventional sequence of AMR-WB+ windows.
Figure 20:
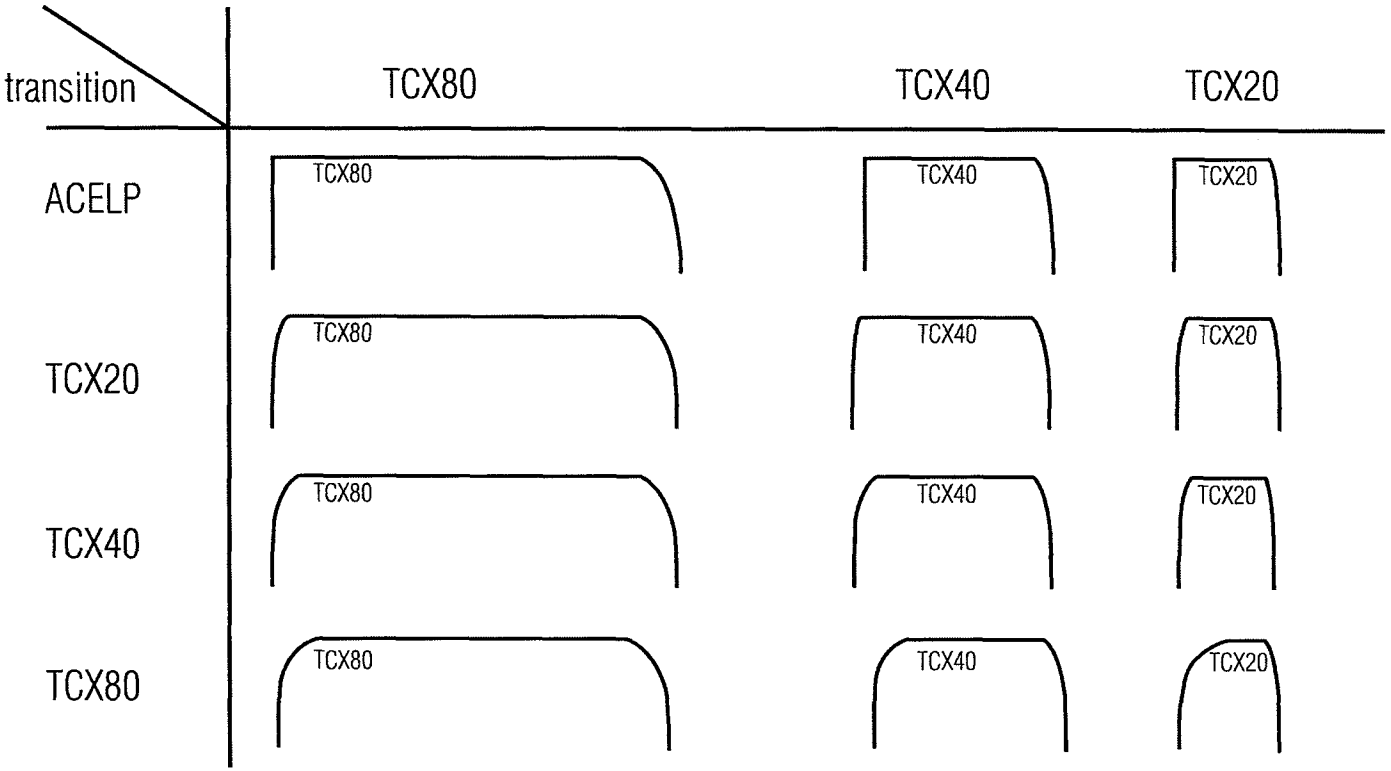
FIG 20 (PRIOR ART)
FIG. 20 illustrates windows used for transmitting in AMR-WB+ between ACELP and TCX.

In the table shown at the bottom of FIG. 13*a*, the differences with respect to the table for the conventional AMR-WB+ as depicted in FIG. 19 are highlighted. The highlighted parameters indicate the advantage of embodiments of the present invention, in which the overlapping area is extended such that cross-over fading can be carried out more smoothly and the frequency response of the window is improved, while keeping critically sampling.

Figure 13B:
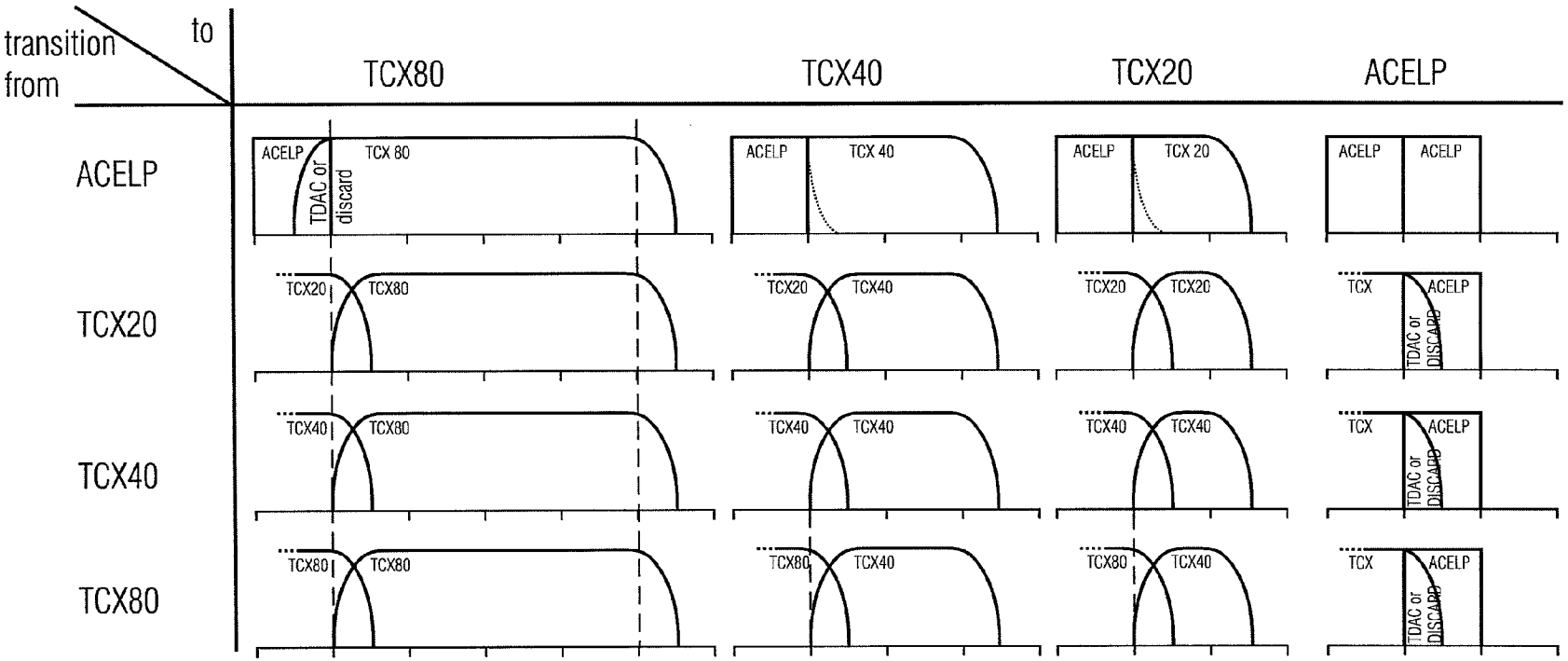
FIG. 13*b* shows possible transitions for an MDCT-based embodiment.
Figure 14A:
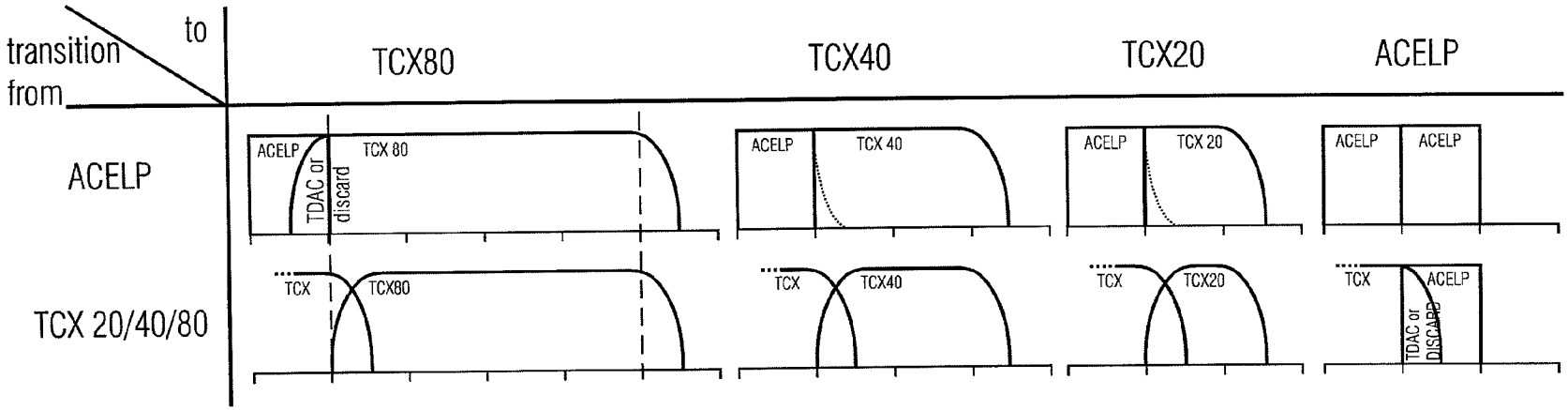
FIG. 14*a* shows a table of possible transitions in an embodiment.

From the table at the bottom of FIG. 13*a* it can be seen, that only for ACELP to TCX transitions an overhead is introduced, i.e. only for this transition T>PR, i.e. non-critical sampling is achieved. For all TCXx to TCXx ("x" indicates any frame duration) transitions the transform length T is equal to the number of new perfectly reconstructed samples, i.e. critical sampling is achieved. FIG. 13*b* illustrates a table with graphical representations of all windows for all possible transitions with the MDCT-based embodiment of AMR-WB+. As already indicated in the table in FIG. 13*a*, the left part L of the windows does no longer depend on the length of a previous TCX frame. The graphical representations in FIG. 14*b* also show that critical sampling can be maintained when switching between different TCX frames. For TCX to ACELP transitions, it can be seen that an overhead of 128 samples is produced. Since the left side of the windows does not depend on the length of the previous TCX frame, the table shown in FIG. 13*b* can be simplified, as shown in FIG. 14*a*. FIG. 14*a* shows again a graphical representation of the windows for all possible transitions, where the transitions from TCX frames can be summarized in one row.

Figure 14B:
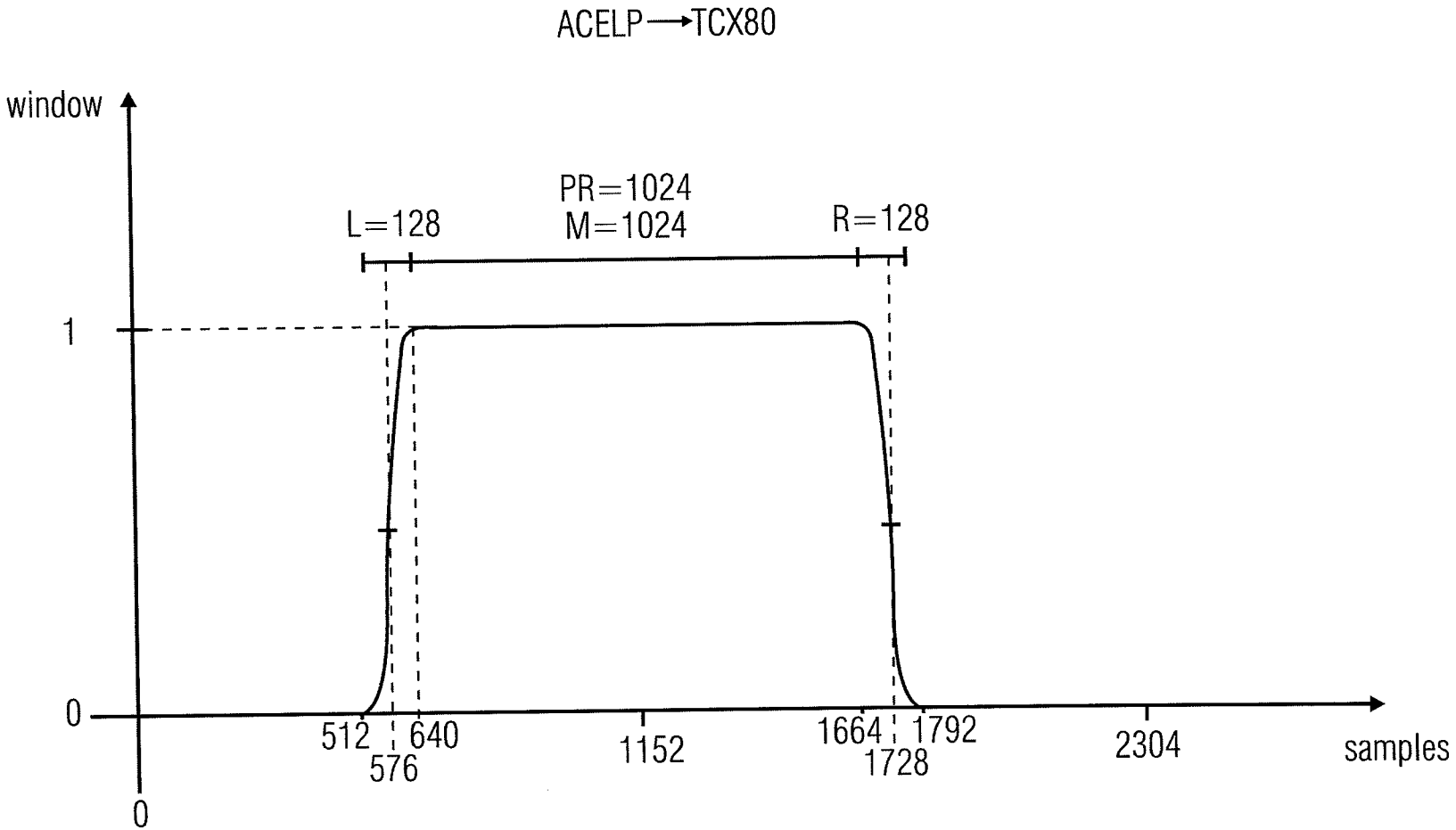
FIG. 14*b* illustrates a transition window from ACELP to TCX80 according to one embodiment.

FIG. 14*b* illustrates the transition from ACELP to a TCX80 window in more detail. The view chart in FIG. 14*b* shows the number of samples on the abscissa and the window function on the ordinate. Considering the input of an MDCT, the left zero part reaches from sample 1 to sample 512. The rising edge part is between sample 513 and 640, the second bypass part between 641 and 1664, the falling edge part between 1665 and 1792, the third zero part between 1793 and 2304. With respect to the above discussion of the MDCT, in the present embodiment 2304 time domain samples are transformed to 1152 frequency domain samples. According to the above description, the time domain aliasing zone of the present window is between samples 513 and 640, i.e. within the rising edge part extending across L=128 samples. Another time domain aliasing zone extends between sample 1665 and 1792, i.e. the falling edge part of R=128 samples. Due to the first zero part and the third zero part, there is a non-aliasing zone where perfect reconstruction is enabled between sample 641 and 1664 of size M=1024. In FIG. 14*b* the ACELP frame indicated by the dotted line ends at sample 640. Different options arise with respect to the samples of the rising edge part between 513 and 640 of the TCX80 window. One option is to first discard the samples and stay with the ACELP frame. Another option is to use the ACELP output in order to carry out time domain aliasing cancellation for the TCX80 frame.

Figure 14C:
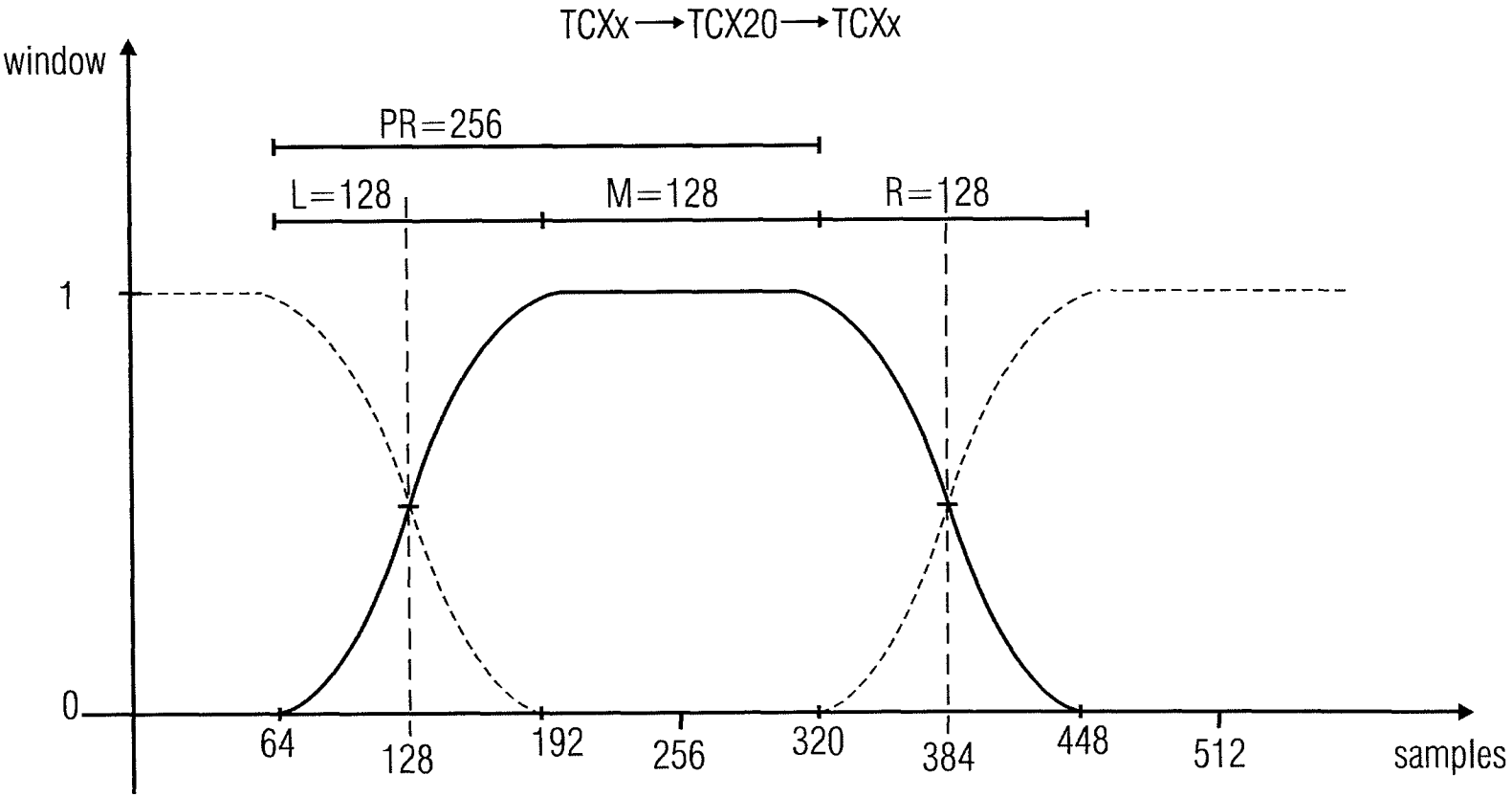
FIG. 14*c* shows an embodiment of a transition window from a TCXx frame to a TCX20 frame to a TCXx frame according to one embodiment.
Figure 14D:
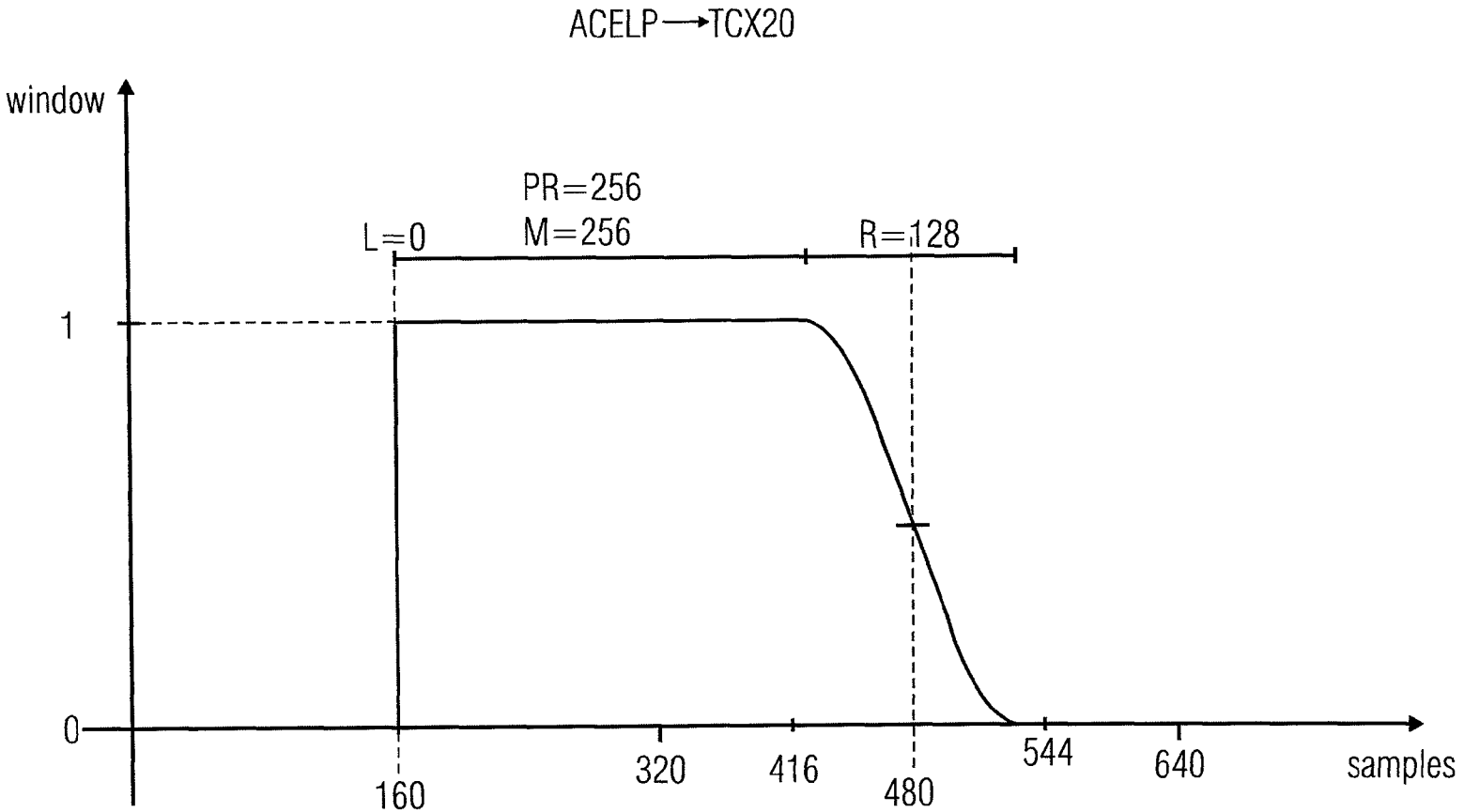
FIG. 14*d* illustrates an embodiment of a transition window from ACELP to TCX20 according to one embodiment.
Figure 14E:
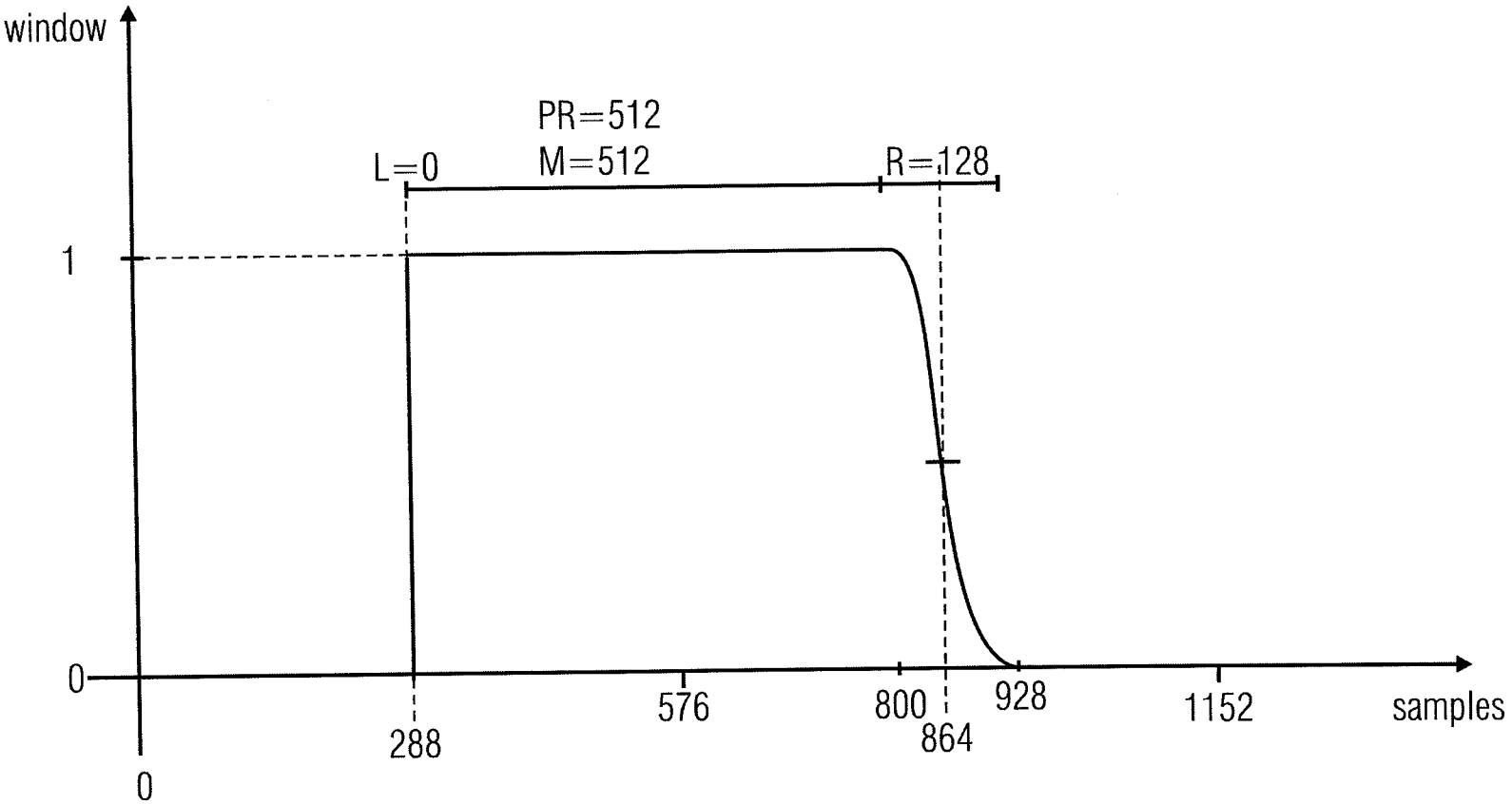
FIG. 14*e* shows an embodiment of a transition window from ACELP to TCX40 according to one embodiment.
Figure 14F:
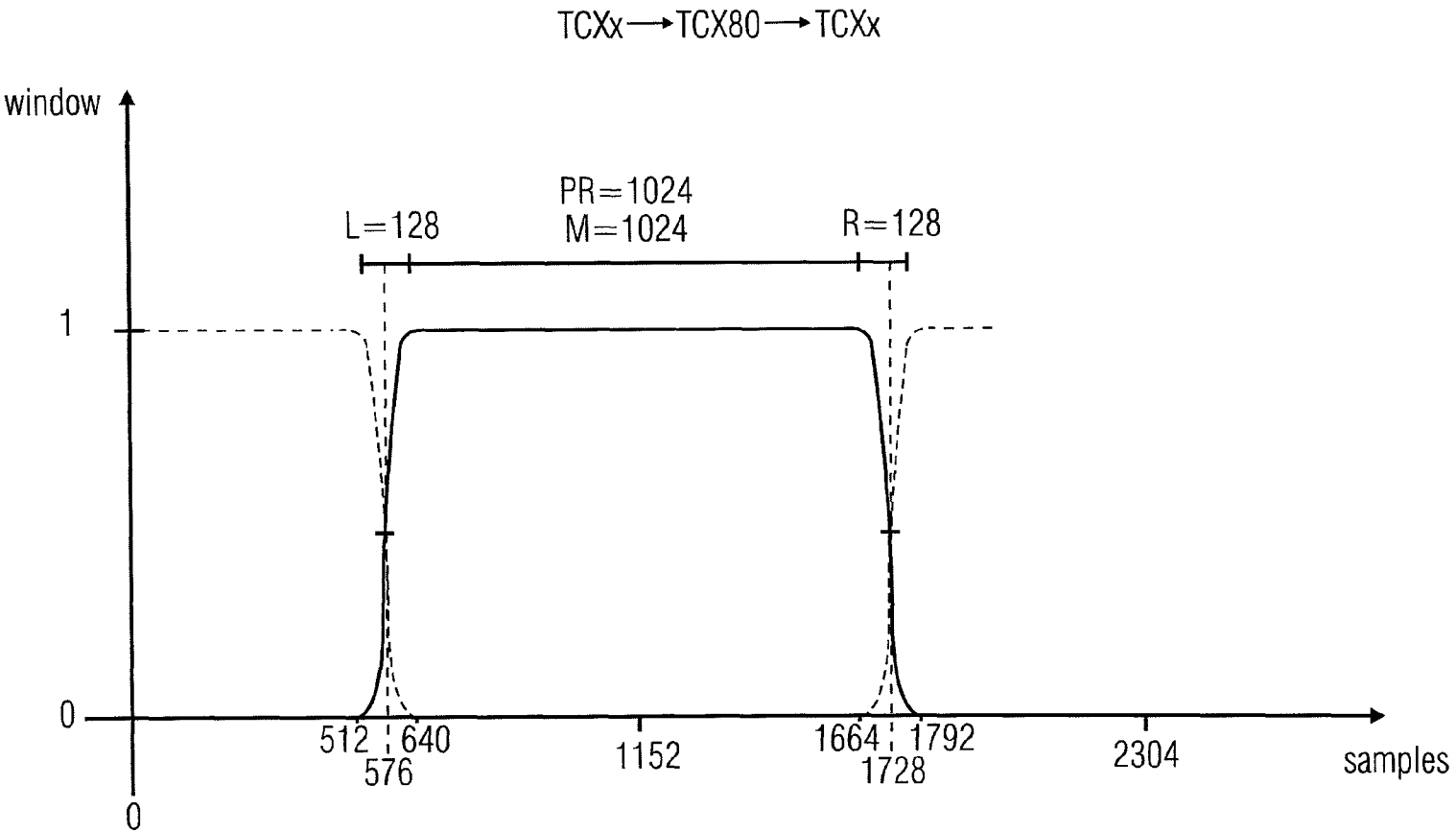
FIG. 14*f* illustrates an embodiment of the transition window for a transition from a TCXx frame to a TCX80 frame to a TCXx frame according to one embodiment.

FIG. 14*c* illustrates the transition from any TCX frame, denoted by "TCXx", to a TCX20 frame and back to any TCXx frame. FIGS. 14*c*[[b]] to 14*f* use the same view graph representation as it was already described with respect to FIG. 14*b*. In the center around sample 256 in FIG. 14*c* the TCX20 window is depicted. 512 time domain samples are transformed by the MDCT to 256 frequency domain samples. The time domain samples use 64 samples for the first zero part as well as for the third zero part. Therewith, a non-aliasing zone of size M=128 extends around the center of the TCX20 window. The left overlapping or rising edge part between samples 65 and 192, can be combined for time domain aliasing cancellation with the falling edge part of a preceding window as indicated by the dotted line. Therewith, an area of perfect reconstruction yields of size PR=256. Since all rising edge parts of all TCX windows are L=128 and fit to all falling edge parts R=128, the preceding TCX frame as well as the following TCX frames may be of any size. When transiting from ACELP to TCX20 a different window may be used as it is indicated in FIG. 14*d*. As can be seen from FIG. 14*d*, the rising edge part was chosen to be L=0, i.e. a rectangular edge. Therewith, the area of perfect reconstruction PR=256. FIG. 14*e* shows a similar view graph when transiting from ACELP to TCX40 and, as another example; FIG. 14*f* illustrates the transition from any TCXx window to TCX80 to any TCXx window.

In summary, the FIGS. 14*b* to *f* show, that the overlapping region for the MDCT windows is 128 samples, except for the case when transiting from ACELP to TCX20, TCX40, or ACELP.

When transiting from TCX to ACELP or from ACELP to TCX80 multiple options are possible. In one embodiment the window sampled from the MDCT TCX frame may be discarded in the overlapping region. In another embodiment the windowed samples may be used for a cross-fade and for canceling a time domain aliasing in the MDCT TCX samples based on the aliased ACELP samples in the overlapping region. In yet another embodiment, cross-over fading may be carried out without canceling the time domain aliasing. In the ACELP to TCX transition the zero-input response (ZIR=zero-input response) can be removed at the encoder for windowing and added at the decoder for recovering. In the figures this is indicated by dotted lines within the TCX windows following an ACELP window. In the present embodiment when transiting from TCX to TCX, the windowed samples can be used for cross-fade.

When transiting from ACELP to TCX80, the frame length is longer and may be overlapped with the ACELP frame, the time domain aliasing cancellation or discard method may be used.

Figure 15:
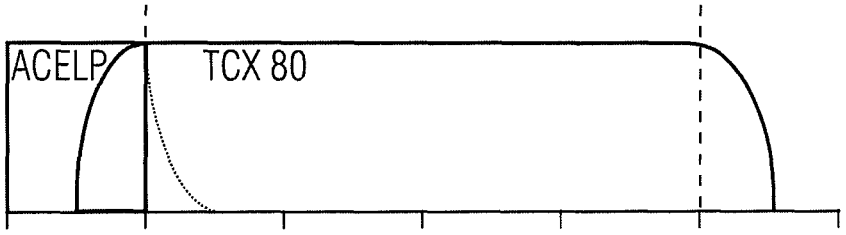
FIG. 15 illustrates an ACELP to TCX80 transition according to one embodiment.
Figure 16:
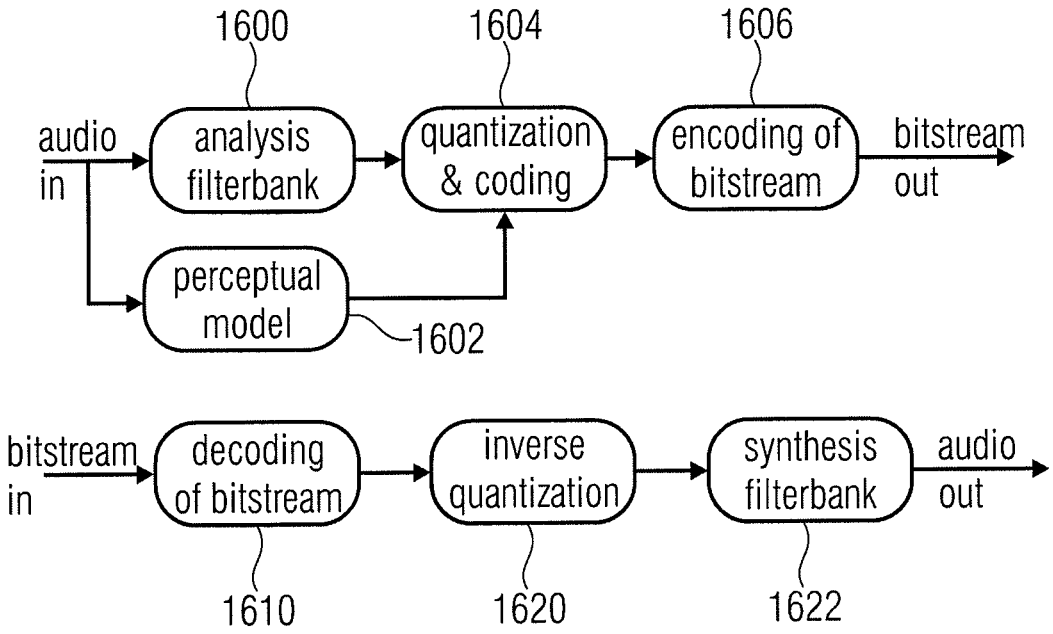
FIG 16 (PRIOR ART)
FIG. 16 illustrates conventional encoder and decoder examples.
Figure 17A:
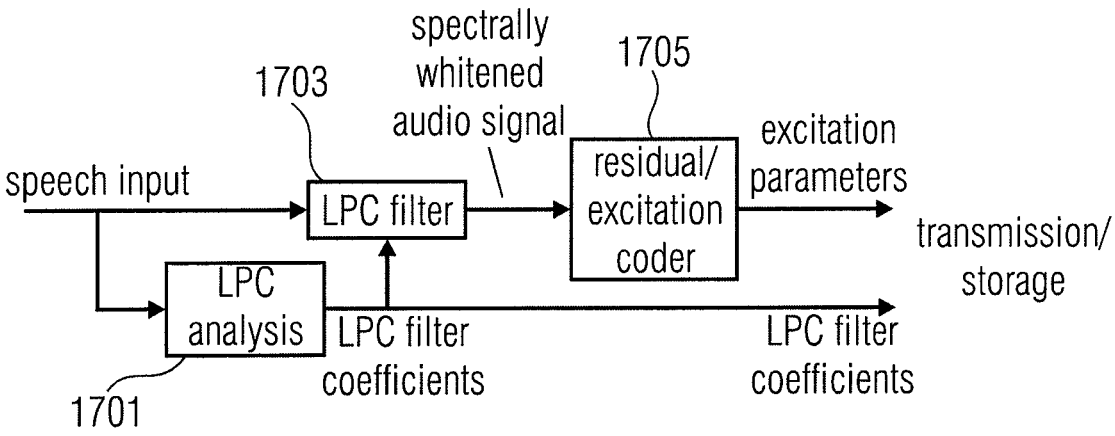
FIG 17A (PRIOR ART)
FIGS. 17*a,b* illustrates LPC encoding and decoding.
Figure 17B:
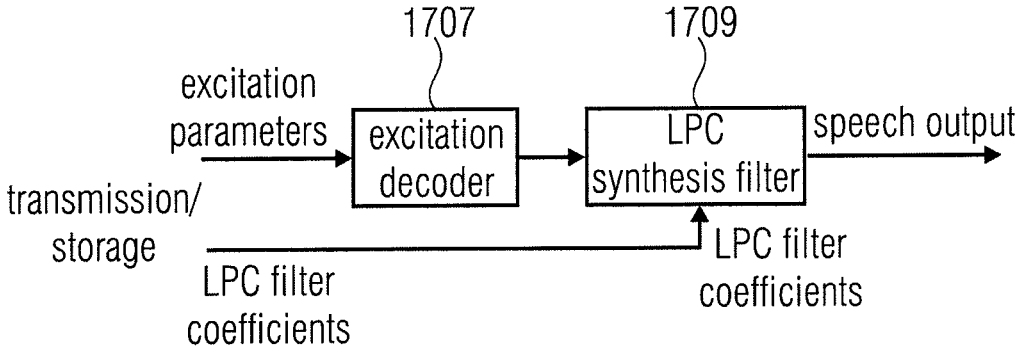
FIG 17B (PRIOR ART)
Figure 18:
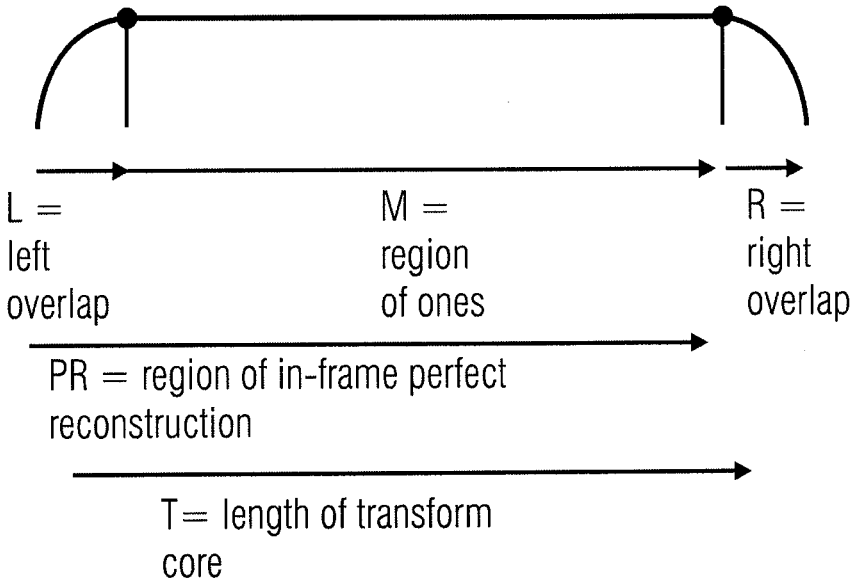
FIG 18 (PRIOR ART)
FIG. 18 illustrates a conventional cross-fade window.

When transiting from ACELP to TCX80 the previous ACELP frame may introduce a ringing. The ringing may be recognized as a spreading of error coming from the previous frame due to the usage of LPC filtering. The ZIR method used for TCX40 and TCX20 may account for the ringing. A variant for the TCX80 in embodiments is to use the ZIR method with a transform length of 1088, i.e. without overlap with the ACELP frame. In another embodiment the same transform length of 1152 may be kept and zeroing of the overlap area just before the ZIR may be utilized, as shown in FIG. 15. FIG. 15 shows an ACELP to TCX80 transition, with zeroing the overlapped area and using the ZIR method. The ZIR part is again indicated by the dotted line following the end of the ACELP window.

Summarizing, embodiments of the present invention provide the advantage that critical sampling can be carried out for all TCX frames, when a TCX frame precedes. As compared to the conventional approach an overhead reduction of $1/8^{th}$ can be achieved. Moreover, embodiments provide the advantage that the transitional or overlapping area between consecutive frames may be 128 samples, i.e. longer than for the conventional AMR-WB+. The improved overlap areas also provide an improved frequency response and a smoother cross-fade. Therewith a better signal quality can be achieved with the overall encoding and decoding process. Depending on certain implementation requirements of the inventive methods, the inventive methods can be implemented in hardware or in software. The implementation can be performed using a digital storage medium, in particular, a disc, a DVD, a flash memory or a CD having electronically readable control signals stored thereon, which cooperate with a programmable computer system such that the inventive methods are performed. Generally, the present invention is therefore a computer program product with a program code stored on a machine-readable carrier, the program code being operated for performing the inventive methods when the computer program product runs on a computer. In other words, the inventive methods are, therefore, a computer program having a program code for performing at least one of the inventive methods when the computer program runs on a computer.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. An audio encoding apparatus adapted for encoding frames of a sampled audio signal to obtain encoded frames, wherein a frame comprises a number of time domain audio samples, comprising:

a predictive coding analysis stage for determining information on coefficients of a synthesis filter and a prediction domain frame based on a frame of audio samples;

a time-aliasing introducing transformer for transforming overlapping prediction domain frames to a frequency domain to obtain prediction domain frame spectra, wherein the time-aliasing introducing transformer is adapted for transforming the overlapping prediction domain frames in a critically-sampled way; and a redundancy reducing encoder for encoding the prediction domain frame spectra to obtain the encoded frames based on the coefficients and encoded prediction domain frame spectra, a codebook encoder for encoding the prediction domain frames based on a predetermined codebook to obtain a codebook encoded prediction domain frame; and a decider for deciding whether to use a codebook encoded prediction domain frame or an encoded prediction domain frame to obtain a finally encoded frame based on a coding efficiency measure.

wherein at least one of the predictive coding analysis stage, the time-aliasing introducing transformer, the redundancy reducing encoder, the codebook encoder, and the decider comprises a hardware implementation.

2. The audio encoding apparatus of claim 1, wherein a prediction domain frame is based on an excitation frame comprising samples of an excitation signal for the synthesis filter.

3. The audio encoding apparatus of claim 1, wherein the time-aliasing introducing transformer is adapted for transforming overlapping prediction domain frames such that an average number of samples of a prediction domain frame spectrum equals the average number of samples in a prediction domain frame.

4. The audio encoding apparatus of claim 1, wherein the time-aliasing introducing transformer is adapted for transforming overlapping prediction domain frames according to a modified discrete cosine transform (MDCT).

5. The audio encoding apparatus of claim 1, wherein the time-aliasing introducing transformer comprises a windowing filter for applying a windowing function to overlapping prediction domain frames and a converter for converting windowed overlapping prediction domain frames to the prediction domain frame spectra.

6. The audio encoding apparatus of claim 5, wherein the time-aliasing introducing transformer comprises a processor for detecting an event and for providing a window sequence information if the event is detected and wherein the windowing filter is adapted for applying the windowing function according to the window sequence information.

7. The audio encoding apparatus of claim 6, wherein the window sequence information comprises a first zero part, a second bypass part and a third zero part.

8. The audio encoding apparatus of claim 7, wherein the window sequence information comprises a rising edge part between the first zero part and the second bypass part and a falling edge part between the second bypass part and the third zero part.

9. The audio encoding apparatus of claim 8, wherein the second bypass part comprises a sequence of ones for not modifying the samples of the prediction domain frame spectra.

10. The audio encoding apparatus of claim 1, wherein the predictive coding analysis stage is adapted for determining the information on the coefficients based on linear predictive coding (LPC).

11. The audio encoding apparatus of claim 1, further comprising a switch coupled to the decider for switching the prediction domain frames between the time-aliasing introducing transformer and the codebook encoder based on the coding efficiency measure.

12. A method for encoding frames of a sampled audio signal to obtain encoded frames, wherein a frame comprises a number of time domain audio samples, comprising determining, by a predictive coding analysis stage, information on coefficients for a synthesis filter based on a frame of audio samples and determining a prediction domain frame based on the frame of audio samples;

transforming, by a time-aliasing introducing transformer, overlapping prediction domain frames to a frequency domain to obtain prediction domain frame spectra in a critically-sampled way introducing time aliasing;

encoding, by a redundancy reducing encoder, the prediction domain frame spectra to obtain the encoded frames based on the coefficients and encoded prediction domain frame spectra;

encoding, by a codebook encoder, the prediction domain frames based on a predetermined codebook to obtain a codebook encoded prediction domain frame; and deciding, by a decider, whether to use a codebook encoded prediction domain frame or an encoded prediction domain frame to obtain a finally encoded frame based on a coding efficiency measure wherein at least one of the predictive coding analysis stage, the time-aliasing introducing transformer, the redundancy reducing encoder, the codebook encoder, and the decider comprises a hardware implementation.

13. A non-transitory storage medium having stored thereon a computer program comprising a program code for performing the method for encoding frames of a sampled audio signal to obtain encoded frames, wherein a frame comprises a number of time domain audio samples, the method comprising determining information on coefficients for a synthesis filter based on a frame of audio samples;

determining a prediction domain frame based on the frame of audio samples;

transforming overlapping prediction domain frames to the frequency domain to obtain prediction domain frame spectra in a critically-sampled way introducing time aliasing; and encoding the prediction domain frame spectra to obtain the encoded frames based on the coefficients and the encoded prediction domain frame spectra, encoding the prediction domain frames based on a predetermined codebook to obtain a codebook encoded prediction domain frame; and deciding whether to use a codebook encoded prediction domain frame or an encoded prediction domain frame to obtain a finally encoded frame based on a coding efficiency measure, when the program code runs on a computer or processor.

14. An audio decoding apparatus for decoding encoded frames to obtain frames of a sampled audio signal, wherein a frame comprises a number of time domain audio samples, comprising:

a redundancy retrieving decoder for decoding the encoded frames to obtain an information on coefficients for a synthesis filter and prediction domain frame spectra;

an inverse time-aliasing introducing transformer for transforming the prediction domain frame spectra to the time domain to obtain overlapping prediction domain frames, wherein the inverse time-aliasing introducing transformer is adapted for determining overlapping prediction domain frames from consecutive prediction domain frame spectra, wherein the inverse time-aliasing introducing transformer further comprises a converter for converting prediction domain frame spectra to converted overlapping prediction domain frames and a windowing filter for applying a windowing function to the converted overlapping prediction domain frames to obtain the overlapping prediction domain frames, wherein the inverse time-aliasing introducing transformer comprises a processor for detecting an event and for providing a window sequence information if the event is detected to the windowing filter and wherein the windowing filter is adapted for applying the windowing function according to the window sequence information, and wherein the window sequence information comprises a first zero part, a second bypass part and a third zero part;

an overlap/add combiner for combining overlapping prediction domain frames to obtain a prediction domain frame in a critically-sampled way; and a predictive synthesis stage for determining the frames of audio samples based on the coefficients and the prediction domain frame, wherein at least one of the redundancy retrieving decoder, the inverse time-aliasing introducing transformer, the overlap/add combiner, and the predictive analysis stage comprises a hardware implementation.

15. The audio decoding apparatus of claim 14, wherein the overlap/add combiner is adapted for combining overlapping prediction domain frames such that an average number of samples in a prediction domain frame equals an average number of samples in a prediction domain frame spectrum.

16. The audio decoding apparatus of claim 14, wherein the inverse time-aliasing introducing transformer is adapted for transforming the prediction domain frame spectra to the time domain according to an inverse modified discrete cosine transform (IMDCT).

17. The audio decoding apparatus of claim 14, wherein the predictive synthesis stage is adapted for determining a frame of audio samples based on linear prediction coding (LPC).

18. The audio decoding apparatus of claim 14, wherein the window sequence further comprises a rising edge part between the first zero part and the second bypass part and a falling edge part between the second bypass part and the third zero part.

19. The audio decoding apparatus of claim 18, wherein the second bypass part comprises a sequence of ones for modifying the samples of the prediction domain frame.

20. A method for decoding encoded frames to obtain frames of a sampled audio signal, wherein a frame comprises a number of time domain audio samples, comprising decoding, by a redundancy retrieving decoder, the encoded frames to obtain an information on coefficients for a synthesis filter and prediction domain frame spectra;

transforming, by the inverse time-aliasing introducing transformer, the prediction domain frame spectra to the time domain to obtain overlapping prediction domain frames from consecutive prediction domain frame spectra, wherein the transforming comprises:

converting prediction domain frame spectra to converted overlapping prediction domain frames, applying a windowing function, by a windowing filter, to the converted overlapping prediction domain frames to obtain the overlapping prediction domain frames, detecting an event, and providing a window sequence information if the event is detected to the windowing filter, wherein the windowing filter is adapted for applying the windowing function according to the window sequence information, and wherein the window sequence information comprises a first zero part, a second bypass part and a third zero part;

combining, by an overlap/add combiner, overlapping prediction domain frames to obtain a prediction domain frame in a critically sampled way; and determining, by a predictive analysis stage, the frame based on the coefficients and the prediction domain frame, wherein at least one of the redundancy retrieving decoder, the inverse time-aliasing introducing transformer, the overlap/add combiner, and the predictive analysis stage comprises a hardware implementation.

21. A non-transitory storage medium having stored thereon a computer program product for performing the method for decoding encoded frames to obtain frames of a sampled audio signal, wherein a frame comprises a number of time domain audio samples, the method comprising decoding the encoded frames to obtain an information on coefficients for a synthesis filter and prediction domain frame spectra;

transforming the prediction domain frame spectra to the time domain to obtain overlapping prediction domain frames from consecutive prediction domain frame spectra, wherein the transforming comprises converting prediction domain frame spectra to converted overlapping prediction domain frames, applying a windowing function, by a windowing filter, to the converted overlapping prediction domain frames to obtain the overlapping prediction domain frames, detecting an event, and providing a window sequence information if the event is detected to the windowing filter, wherein the windowing filter is adapted for applying the windowing function according to the window sequence information, and wherein the window sequence information comprises a first zero part, a second bypass part and a third zero part;

combining overlapping prediction domain frames to obtain a prediction domain frame in a critically sampled way; and determining the frame based on the coefficients and the prediction domain frame, when the computer program runs on a computer or processor.

* * * * *